US007998038B2

(12) United States Patent
Keiser

(10) Patent No.: US 7,998,038 B2
(45) Date of Patent: Aug. 16, 2011

(54) EXERCISE APPARATUS USING WEIGHT AND PNEUMATIC RESISTANCES

(75) Inventor: Dennis L. Keiser, Sanger, CA (US)

(73) Assignee: Keiser Corporation, Fresno, CA (US)

( * ) Notice: Subject to any disclaimer, the term of this patent is extended or adjusted under 35 U.S.C. 154(b) by 1865 days.

(21) Appl. No.: 11/102,545

(22) Filed: Apr. 7, 2005

(65) Prior Publication Data

US 2005/0239612 A1 Oct. 27, 2005

Related U.S. Application Data

(63) Continuation-in-part of application No. 10/880,165, filed on Jun. 28, 2004.

(60) Provisional application No. 60/483,573, filed on Jun. 27, 2003, provisional application No. 60/555,577, filed on Mar. 22, 2004, provisional application No. 60/555,723, filed on Mar. 23, 2004.

(51) Int. Cl.
*A63B 21/00* (2006.01)

(52) U.S. Cl. ..... 482/112; 482/139; 482/94

(58) Field of Classification Search ..... 482/104–108; 128/848, 861, 201.11; 428/121, 10, 11, 44
See application file for complete search history.

(56) References Cited

U.S. PATENT DOCUMENTS 1,015,071 A 1/1912 Reach
3,074,716 A 1/1963 Mitchel et al.
3,387,843 A 6/1968 Chandler
3,465,592 A 9/1969 Perrine
3,481,198 A 12/1969 Williams
3,717,342 A * 2/1973 Haney et al. ..... 473/430
3,896,672 A 7/1975 Henson et al.
4,227,689 A 10/1980 Keiser
4,257,593 A 3/1981 Keiser
4,326,707 A 4/1982 Strecker
4,357,010 A 11/1982 Telle
4,426,077 A * 1/1984 Becker ..... 482/92
4,720,103 A 1/1988 Palladino
4,750,739 A 6/1988 Lange et al.
4,765,611 A * 8/1988 MacMillan ..... 482/98
4,880,227 A 11/1989 Sowell
5,102,122 A 4/1992 Piane, Jr. et al.
(Continued)

FOREIGN PATENT DOCUMENTS

GB 2240727 4/1991
(Continued)

OTHER PUBLICATIONS

Invitation to Pay Additional Fees with Partial International Search for Application No. PCT/US2004/020797, mailed Dec. 28, 2005.

*Primary Examiner* — Jerome W Donnelly
(74) *Attorney, Agent, or Firm* — Knobbe Martens Olson & Bear LLP

(57) ABSTRACT

An exercise apparatus is disclosed that comprises a frame, at least one user interface movably coupled to the frame, a pneumatic resistance device, and a weight stack coupled to the frame. The weight stack is arranged between and in series with the at least one user interface and pneumatic resistance device and is coupled to the at least one user interface by a first force transfer mechanism and to the pneumatic resistance device by a second force transfer mechanism.

11 Claims, 14 Drawing Sheets

U.S. PATENT DOCUMENTS

| | | | |
|---|---|---|---|
| 5,184,992 | A | 2/1993 | Banks |
| 5,310,394 | A | 5/1994 | Kallios |
| 5,403,257 | A | 4/1995 | Lehtonen |
| 5,429,569 | A | 7/1995 | Gunnari et al. |
| 5,653,666 | A | 8/1997 | Pantoleon |
| 5,738,617 | A | 4/1998 | Watson |
| 5,823,921 | A | 10/1998 | Dawson et al. |
| 5,890,996 | A | 4/1999 | Frame et al. |
| 5,951,449 | A | 9/1999 | Oppreicht et al. |
| 6,142,919 | A | 11/2000 | Jorgensen |
| 6,482,128 | B1 | 11/2002 | Michalow |
| 7,074,164 | B2 | 7/2006 | Moring et al. |
| 7,104,936 | B2 | 9/2006 | Karlstrom |
| 2003/0115955 | A1 | 6/2003 | Keiser |

FOREIGN PATENT DOCUMENTS

| | | |
|---|---|---|
| WO | WO 03/041809 | 5/2003 |

* cited by examiner

EXERCISE APPARATUS USING WEIGHT AND PNEUMATIC RESISTANCES

RELATED APPLICATIONS

This application is a continuation-in-part of U.S. patent application Ser. No. 10/880,165, filed Jun. 28, 2004, which claims priority under 35 U.S.C. §119(e) to U.S. Provisional Application No. 60/483,573, filed on Jun. 27, 2003, U.S. Provisional Application No. 60/555,577, filed on Mar. 22, 2004, and U.S. Provisional Application No. 60/555,723, filed on Mar. 23, 2004. The entire contents of all of the above applications are herein incorporated by reference in their entirety.

BACKGROUND OF THE INVENTION

1. Field of the Invention

The present invention relates to an exercise apparatus and, more particularly, to an adjustable exercise apparatus that allows for variable amounts of resistances to be applied using weight resistance (e.g., iron plates), pneumatic resistance, or both weight and pneumatic resistances.

2. Description of the Related Art

Weight lifting for exercise and strength training commonly involves lifting iron weights. Typically, the weights are fixed to a bar (e.g., a barbell), are freely added to or removed from a weight-lifting bar (e.g., as with free weights), or are part of a weight stack in which the number of weight plates resisting movement of a handle or a bar can be varied. Examples of weight stack machines are disclosed in U.S. Pat. Nos. 6,447,430, 5,776,040, and 4,500,089. When users lift iron weights, the weights provide resistance to the exertion of muscular force. The resistance experienced by the user changes, however, depending upon the speed at which the concentric or eccentric movement of the weight occurs. For example, at the top of a concentric movement, the resistance often decreases as the weight lifter decelerates the weight.

Pneumatic exercise equipment has been developed in response to this shortcoming of weights. Such exercise equipment simulates the desired characteristics of a weight stack machine by permitting the weight lifter to quickly and easily increase or decrease the resistance. Moreover, pneumatic exercise equipment also provides a constant resistance because such machines do not have significant inertial effects. Consequently, pneumatic exercise equipment ensures full muscular effort throughout the stroke.

Pneumatic exercise equipment is typically configured similarly to weight stack equipment and therefore does not require, like free weights would, that the user balance the weight during each exercise repetition. Free weights also provide the user with greater freedom of movement than typical pneumatic exercise equipment, which requires the user to move a bar or handle along a predefined path. Accordingly, for many weight lifters, pneumatic exercise equipment does not provide the feel to which they are accustomed.

SUMMARY OF THE INVENTION

An aspect of the present invention involves the recognition of a need for an exercise machine that combines the advantages of free weights (e.g., balance control training, freedom of movement) with the advantages of pneumatic resistance (e.g., applied resistance throughout exercise stroke, reduced impact on joints, use for developing explosive power). In accordance with this aspect of the present invention, an exercise apparatus comprises a user interface adapted to be moved by a user towards and away from a stationary portion of the user's body (e.g., a center of the user's torso when bench pressing or the user's feet when squatting). A weight is selectively coupled to the user interface, and a pneumatic resistance device is also selectively coupled to the user interface independently of the weight. The pneumatic resistance device includes at least one valve to regulate the amount of resistance that the pneumatic resistance device applies to oppose movement of the user interface in at least one direction away from or towards the stationary portion of the user's body.

According to another aspect of the present invention, the exercise apparatus may further comprise at least one actuator for controlling the at least one valve, the actuator being configured to be manipulated by the user while the user is in an exercise position.

Another aspect of the present invention involves an exercise apparatus comprising a frame including at least a pair of bar supports. The bar supports are spaced apart from each other by a sufficient distance to support a weight-lifting bar. At least a portion of one pneumatic resistance device is coupled to the frame. The pneumatic resistance device comprises a pneumatic actuator having a cylinder and a piston rod that extends from the cylinder along a stroke axis, at least a first pulley coupled to the piston rod and a cable extending at least in part between the pulley and a coupler. The coupler is adapted to be selectively coupled to the weight-lifting bar so as to selectively connect the pneumatic resistance device with the weight-lifting bar.

According to another aspect of the present invention, the exercise apparatus may further comprise at least one actuator for controlling a level of resistance provided by the pneumatic resistance device, the actuator being configured to be manipulated by a user while the user is in an exercise position.

An additional aspect of the present invention involves an exercise apparatus comprising a track and a pneumatic resistance unit including a pneumatic actuator having a linear stroke axis that lies generally normal to at least a section of the track. At least one end of the pneumatic actuator is fixed relative to the track. A trolley is coupled to and freely movable along the track. The apparatus also includes a user interface and a flexible transmitter. The flexible transmitter extends between the pneumatic resistance unit and the user interface and is guided in part by the trolley.

An additional aspect of the present invention involves an exercise apparatus comprising an actuator for controlling a level of resistance provided by the pneumatic resistance unit, the actuator being configured for manipulation by a user while the user is in an exercise position.

In another aspect of the invention, an exercise apparatus is provided that comprises a frame defining an exercise station. The exercise station is sized to accommodate an exercise bench. At least one pneumatic resistance device is attached to the frame, and at least one foot actuator is provided to establish a level of resistance provided by the pneumatic resistance device. The foot actuator in provided near the frame at a location where a user can actuate the foot actuator while the user is positioned to exercise at the exercise bench.

According to one aspect of the invention, an exercise apparatus is provided that comprises a user interface adapted to be moved by a user towards and away from a stationary position of the user's body. The exercise apparatus further comprises a weight stack coupled to the user interface, and a pneumatic resistance device coupled to the weight stack. The pneumatic resistance device includes at least one valve to regulate the amount of resistance that the pneumatic resistance device applies to oppose movement of the weight stack in at least one direction.

According to another aspect of the invention, a method of exercising is disclosed. The method comprises the steps of selecting an amount of resistance exerted by a pneumatic resistance unit, and selecting an amount of weight on a weight stack. The user interface is moved from an initial position through a concentric exercise motion to apply a pulling force on a first cable permanently coupled to the weight stack, which in turn exerts a pulling force on a second cable permanently coupled to the pneumatic resistance unit. The user interface is also moved through an eccentric exercise motion towards the initial position so as to allow the second cable to be drawn back towards the pneumatic resistance device under the force of the pneumatic resistance device and the first cable to be drawn back towards the weight stack under the force of the pneumatic resistance device and weight stack.

According to another aspect of the invention, an exercise apparatus comprises a pneumatic resistance device, a user interface, and a weight stack permanently coupled to the at least one user interface and pneumatic resistance device.

According to another aspect of the invention, an exercise apparatus is disclosed that comprises a frame, at least one user interface movably coupled to the frame, a pneumatic resistance device, and a weight stack coupled to the frame. The weight stack is arranged between and in series with the at least one user interface and pneumatic resistance device and is coupled to the at least one user interface by a first force transfer mechanism and to the pneumatic resistance device by a second force transfer mechanism.

According to still another aspect of the invention, an exercise apparatus comprises at least one user interface, a weight stack having a shaft for selecting an amount of weight, the at least one user interface being coupled to the shaft, and a pneumatic resistance device coupled to the shaft.

These and other aspects, features and advantages of the present invention will become readily apparent to those skilled in the art from the following detailed description of the preferred embodiment, which refers to the attached figures. The invention is not limited, however, to the particular embodiment and variations thereof that are disclosed.

BRIEF DESCRIPTION OF THE DRAWINGS

The shown embodiments are intended to illustrate, but not to limit the invention. The drawings contain the following figures.

DETAILED DESCRIPTION OF THE PREFERRED EMBODIMENT

Figure 1:
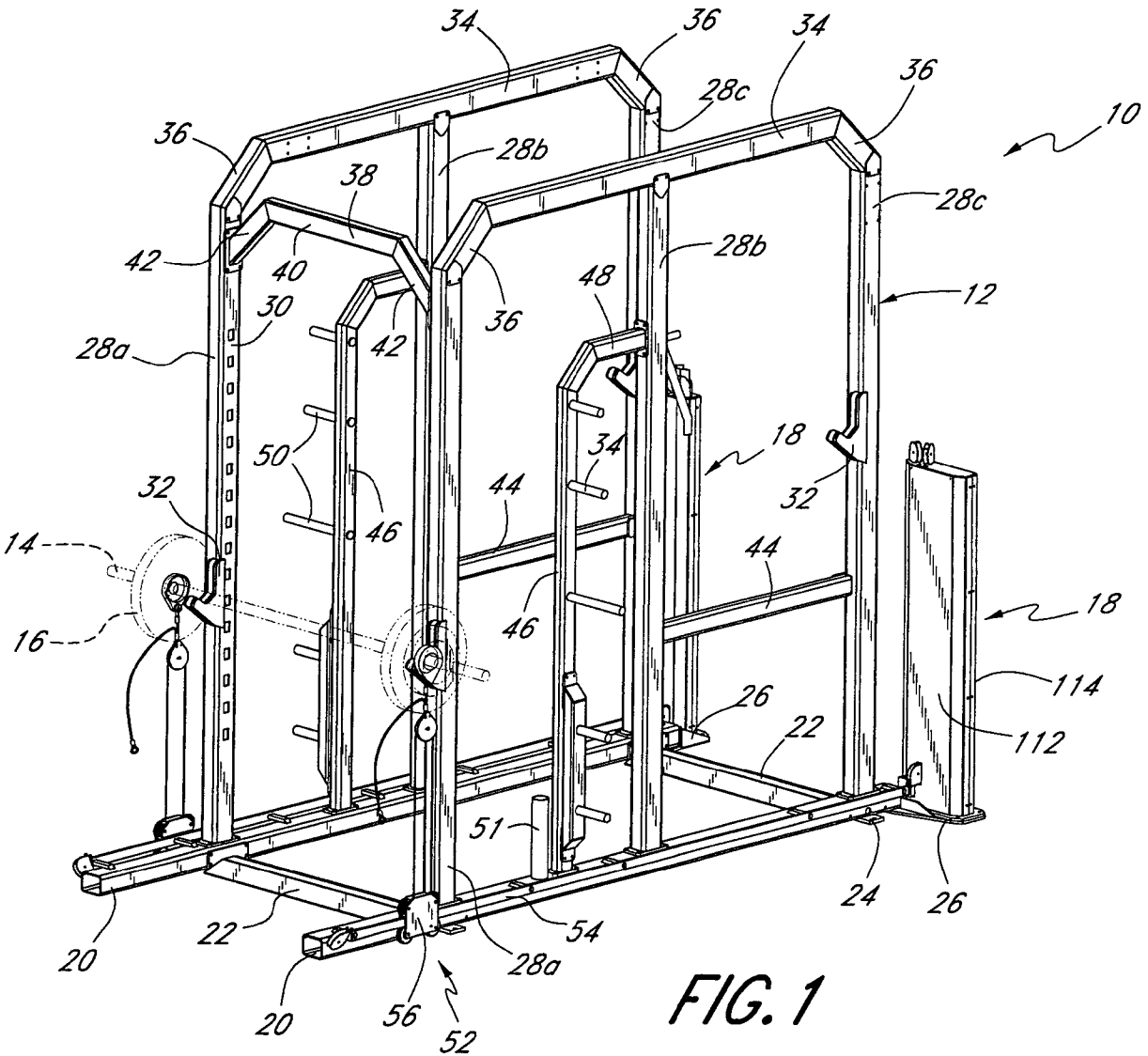
FIG. 1 is a perspective view of an exercise apparatus configured in accordance with a preferred embodiment of the present invention.

The exercise apparatus 10 illustrated in FIG. 1 marries traditional weight training with pneumatic-resistance training. While the present embodiment illustrates the apparatus as adapted for use with free-weights, the apparatus can also be used with one or more weight stacks or other weight-based resistance devices. Alternatively, the exercise apparatus 10 can be used solely with pneumatic resistance but may facilitate movements similar to those used with free weights.

Figure 10A:
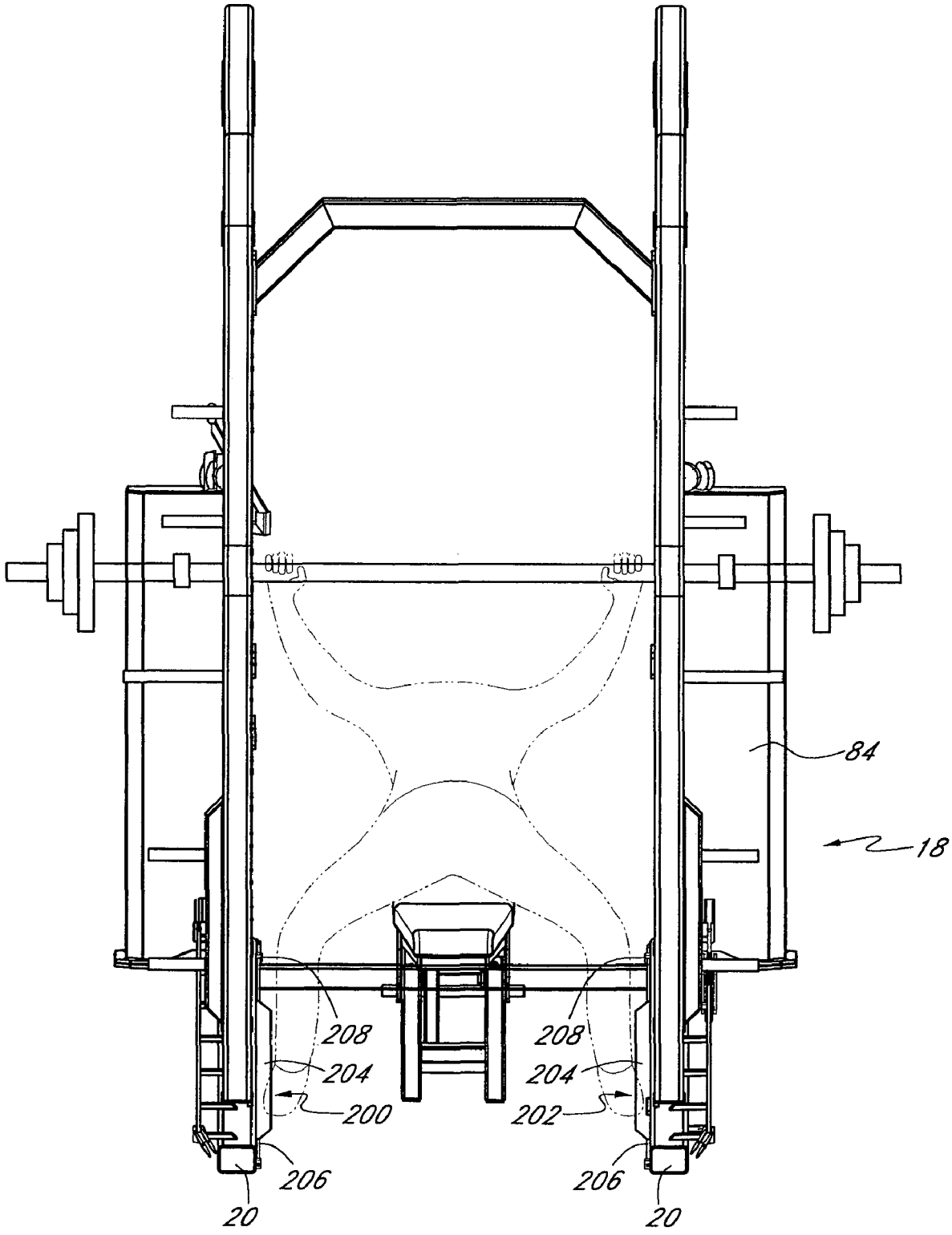
FIG. 10A is a perspective view as seen from one end of an exercise apparatus, which is configured in accordance with another preferred embodiment of the present invention. The illustrated exercise apparatus includes a pneumatic resistance device and a pair of actuators that can be used to change the resistance level provided by the pneumatic resistance device.

The exercise apparatus 10 includes a frame 12 that can support a weight-lifting bar 14 ("weight bar") and a plurality of free weight plates 16. The frame 12 defines at least one exercise station (either a half or a full station) and preferably two or more stations. The embodiment illustrated in FIG. 1 includes one full station and one half station. A user can sit, stand or recline at each station. For example, a bench can be used in a well known manner with the illustrated exercise apparatus 10, as shown in FIG. 10A.

The exercise apparatus 10 also includes at least one pneumatic resistance unit 18 that cooperates with the weight bar 14. The illustrated embodiment uses two resistance units 18. A user can selectively attach the pneumatic resistance units 18 to each side of the weight bar 14, with or without free weight plates 16. The coupler between each resistance unit 18 and the weight bar 14 (which will be described below) allows for relatively free movement of the weight bar 14 within or proximate to the frame 12. That is, the coupler does not restrict the user's movement of the weight bar 14 to a particular course of travel. As a result, the user may move the weight through a variety of paths within the frame, and must balance the weight bar 14 as he or she would normally do with free weights.

Frame

Figure 2:
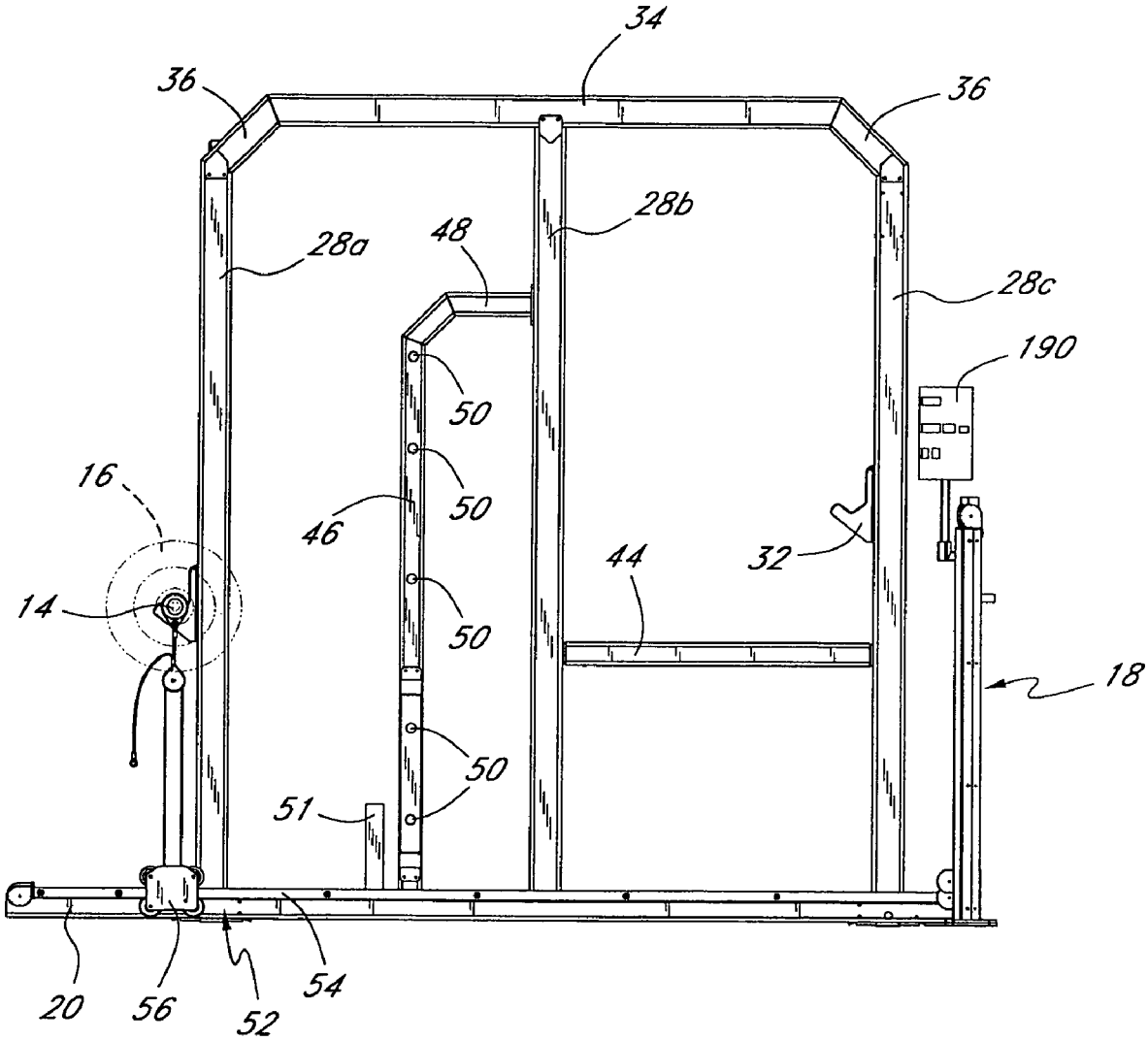
FIG. 2 is a side elevational view of the exercise apparatus of FIG. 1.

With reference now to FIGS. 1 and 2, the frame 12 preferably comprises a plurality of vertical supports and cross braces that together preferably form a cage-like structure. However, alternative configurations are possible, such as a traditional rack-like structure.

In the illustrated embodiment, the frame 12 comprises a base sub-assembly formed by two base members 20 and two cross members 22. The cross members 22 extend between the two base members 20 to form a generally rectangular frame structure with portions of each base member 22 extending beyond the rectangular frame structure at both ends of the respective base member 20.

Each base member 20 preferably includes one or more mounting flanges 24 that are positioned to contact the surface (e.g., floor) that supports the frame 12. The flanges 24 include mounting holes through which a suitable fastener (e.g., a bolt) can pass to anchor the frame 12 in place.

In the illustrated embodiment, a mounting platform 26 is also attached to an end of each base member 20. The mounting platforms 26 preferably lie at the same end of the frame 12, as seen in FIG. 1. Brace structures can be used between the mounting platforms 26 and the base members 20 to secure them firmly together. As described below, one of the resistance units 18 is secured to each of the mounting platforms 26 to affix the respective resistance unit 18 to the frame 12.

Three upright members 28*a*, 28*b*, 28*c* extend upward from each base member 20. At least one pair of upright members 28*a*, 28*b*, 28*c* includes a series of apertures 30 that extend over a length of the upright members. The apertures 30 are configured to cooperate with hooks on bar catches 32. In this manner, the vertical position of the bar catches 32, and thus of the starting position for the weight bar 14, can be changed to accommodate different size users as well as to be readjusted for different exercises (e.g., moving from a lower position for bench press to a higher position for squats).

The upright members 28*a*, 28*b*, 28*c* on each side of the frame 12 terminate at or generally at a respective cap member 34. Each center upright member 28*b* is directly connected to the respective cap member 34, while each end upright member 28*a*, 28*c* is connected to the respective cap member 34 by an angled member 36 that generally lies at a 45° angle with respect to the upright member 28*a*, 28*c* and the cap member 34.

At least one upper cross member 38 connects the upper ends of two opposing end upright members, such as upright members 28*a* in the illustrated embodiment. The upper cross member 38 preferably is formed by a center section 40 and angled end sections 42. Each angled section 42 extends upward at about a 45° angle from the respective upright members 28*a*.

The frame 12 can also include safety bars and storage for free weights. In the illustrated embodiment, the frame includes a pair of safety bars 44 that preferably lie generally at the same height on either side of the frame 44. Each safety bar 44 extends between an end upright member 28*c* and the corresponding center upright member 28*b*. The ends of each safety bar 44 preferably are releasably attached to the upright members 28*b*, 28*c*, and, more preferably, the safety bars 44 and the upright members 28*b*. 28*c* are configured to provide multiple points of attachment for varying the height of the safety bars on the frame. Additionally, the safety bars 44 can be reinforced with external bracing and/or internal structure. In one variation, however, the safety bars 44 can be affixed (e.g., welded) to the upright members 28*b*, 28*c* at a set height.

Additional upright members 46 may provide locations on the frame 12 to store free weight plates 16 when not loaded onto the weight bar 14. In the illustrated embodiment, each upright member 46 rises from one of the base members 20 and is linked to the adjacent center upright member 28*b* by a lateral brace 48. Each upright member 46 supports a plurality of pegs 50 to provide weight storage on each side of the frame 12. Each peg 50 extends generally horizontally or slightly skewed from the horizontal so as to slope downward toward the corresponding upright member 46. The length of each peg 50 and the spacing between adjacent pegs 50 are selected to accommodate various size weight plates 16, as known in the art.

The frame 12 can also include a hollow, tubular member 51 that is disposed next to one of the storage upright members 46. The tubular member 51 has a sufficiently sized inner diameter to receive an end of the weight bar 14 for storage purposes, as known in the art.

In one embodiment, the frame has a width of about 50 inches, a height of about 109 inches, a length of about 126 inches, and an inner width of about 43 inches between the upright members 28*a*, 28*b*, 28*c*. The safety bars 44 are adjustable in 4 inch increments.

The upright members 28*a*, 28*b*, 28*c*, 46, the base members 20, the safety bars 44 and the lower and upper cross members 22, 38 are all preferably formed of a suitably rigid material, such as, for example, cold rolled tube steel having a suitable wall thickness. These members of the frame 12 preferably are welded together, along with the other flanges 24, 26, brackets and braces on the frame 12. The entire frame 12 preferably is painted and more preferably is powder coat painted. Some portions of the frame can also be coated or overlaid with plastic, foam, rubber guards or shields. Of course, the illustrated frame configuration is but one example, and the frame can be formed of other suitable materials, can be assembled using other suitable fasteners, connectors or methods, and can be finished using other suitable materials and techniques.

Track Assemblies

Figure 3:
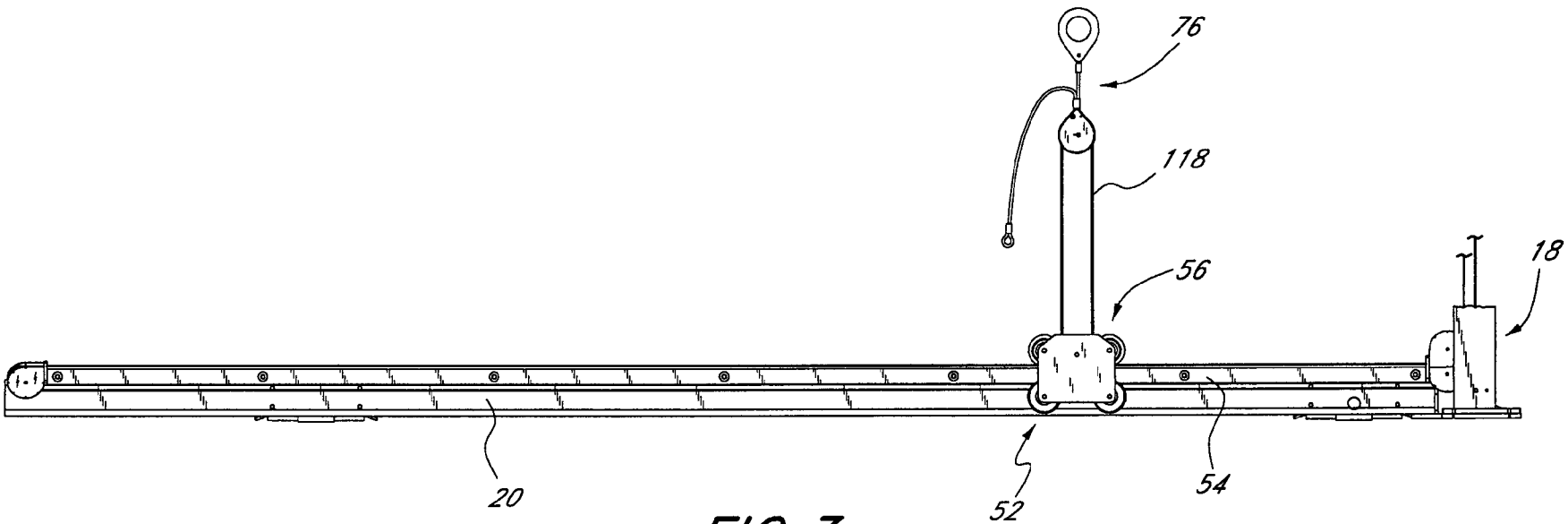
FIG. 3 is an enlarged side elevational view of a track assembly of the exercise apparatus of FIG. 1.

With reference to FIGS. 1 and 3, the exercise apparatus 10 also includes one or more track assemblies 52 attached to the frame 12. In the illustrated embodiment, the exercise apparatus 10 includes two track assemblies 52, each of which includes an elongated, horizontally extending track 54. However, the track can have other orientations (e.g., inclined) and other shapes (e.g., curved) on the frame depending upon the desired exercise motion relative to the frame. Each track 54 in the illustrated embodiment extends parallel to and is supported by one of the base members 20. Each track 54 preferably is located on the frame 12 at a location generally removed from where a user would stand, sit or recline when using the exercise apparatus 10. In the illustrated embodiment, the tracks 54 are located on the outer sides of the base members 20.

Each track assembly 52 also includes a trolley 56 that moves along the track 54. In some applications, such as in the illustrated embodiment, the trolley 56 can freely move along the track 54 at all times; however, in other applications, the trolley 56 can be locked or set in a specific location along the track 54.

Figure 4:
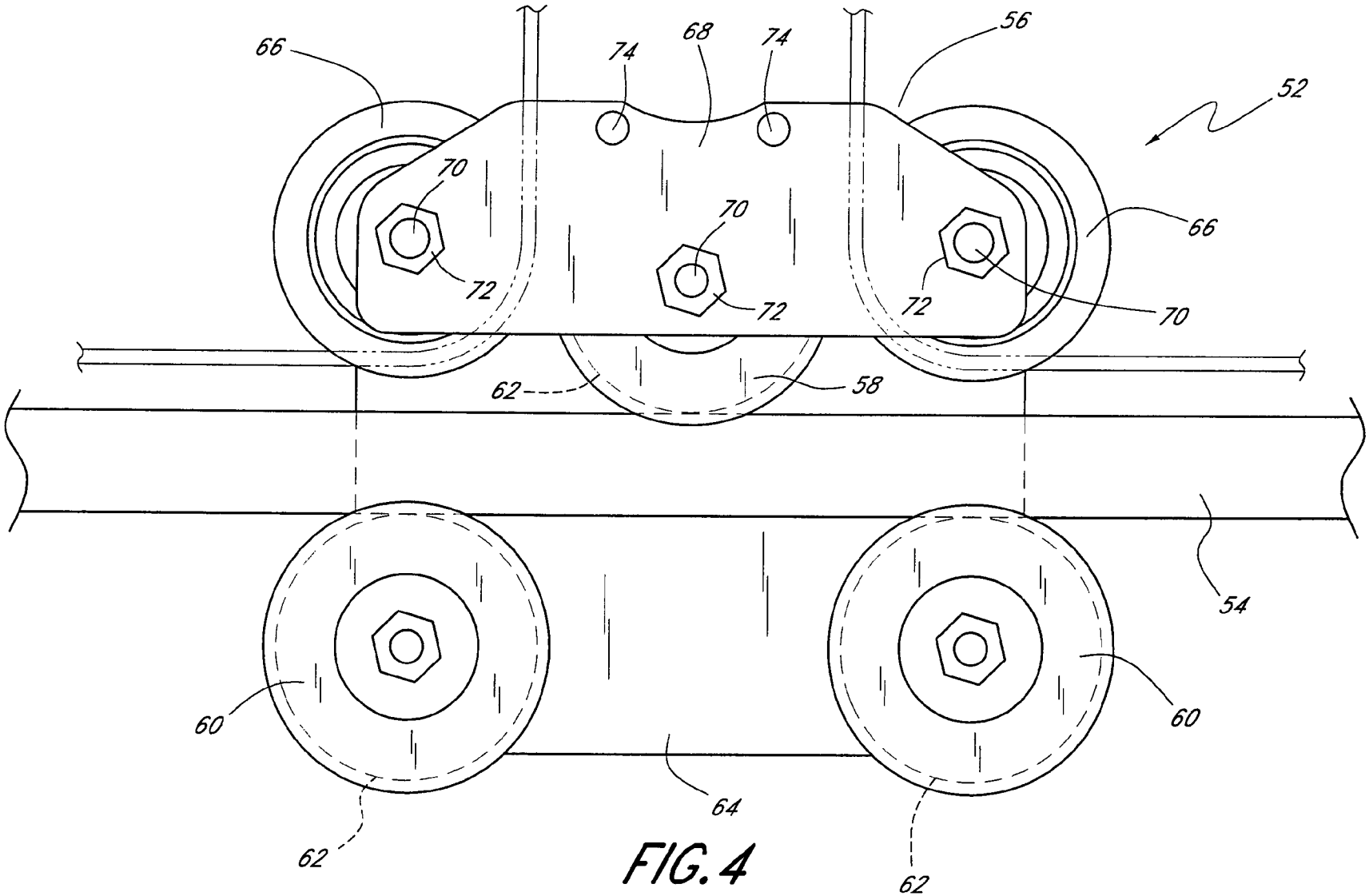
FIG. 4 is a further enlarged side elevational view of a section of track and a trolley of the track assembly of FIG. 3.

As best seen in FIG. 4, the trolley 56 in the illustrated embodiment includes three wheels: one wheel 58 located above the track 54 and two wheels 60 located below the track 54. Each wheel 58, 60 has a central groove 62 (similar to a pulley) of a generally constant width. The width of the central groove 62 of each wheel 58, 60 is sufficient to receive a respective edge (either upper or lower) of the track 54.

The wheels 58, 60 are interconnected so as to hold the trolley 56 on the track 54 and to prevent the trolley 56 from rocking (i.e., pitching) while rolling along the track 54. In the illustrated embodiment, each wheel 58, 60 is attached to a side plate 64 to hold the wheels 58, 60 in a generally triangular pattern. That is, the rotational axis of each wheel 58, 60 as fixed on the plate 64 lies generally at the corners of a triangle. Preferably, the axis of the upper wheel 58 lies along a line that bisects the triangular pattern.

The trolley 56 also includes a pair of pulleys 66 that are disposed above the track 54 and on opposite sides of the upper wheel 58. That is, each pulley 66 is set just to one side of the upper wheel 58.

The side plate 64 and a pulley support plate 68 hold the pulleys 66 in their respective positions. The pulley support plate 68 lies on one side of the track 54 (e.g., the inner side in the illustrated embodiment), and the side plate 64 lies on the other side of the track 54 (e.g., the outer side in the illustrated embodiment). The pulleys 66 and the upper wheel 58 are located between the side plate 64 and the pulley support plate 68.

As seen in FIG. 4, the rotational axes of the wheel 58 and the pulleys 66 are defined by bolts 70 in the illustrated embodiment that pass through both plates 64, 68. Nuts 72 secure the bolts 70 and the plates 64, 68 together. In the illustrated embodiment, the axes of the pulleys 66 is slightly raised relative to the axis of upper wheel 58 in order to position the bottom edge of each pulley 66 above the track 54, as noted above.

One or more spacers 74 preferably are located between the plates 64, 68 to allow the upper wheel 58 and the pulleys 66 to rotate freely. For this purpose, each spacer 74 has a length greater than the widths of the upper wheel 58 and the pulleys 66. The spacers 74 in the illustrated embodiment have a tubular shape and are fitted between to the plates 64, 68.

Resistance Units

As noted above, the exercise apparatus 10 includes at least one pneumatic resistance unit (i.e., power module) that allows a user to work against pneumatic resistance, either in combination with or apart from the weight plates 16. In the illustrated embodiment, one resistance unit 18 cooperates with each track assembly 52, and each resistance unit 18 is attached to the frame assembly 12 at the end of the respective track 54.

The resistance units 18 in the illustrated embodiment cooperate together in order to apply the same level of resistance; however, in some applications, the resistance units 18 can operate independently of each other.

With reference to the illustrated embodiment of FIGS. 1, 3, 5, 5A and 6, each pneumatic resistance unit 18 includes a coupler 76 that couples the resistance unit 18 to the weight bar 14, an extension mechanism 78 that provides a range of movement to the coupler 76, a resistance assembly 80 that resists movement of the coupler 76, a coupling mechanism 82 that couples the resistance assembly 80 to the extension mechanism 78, and a housing 84. The housing 84 preferably supports and encloses the resistance assembly 80, the coupling mechanism 82, and at least a portion of the extension mechanism 78.

Figure 6:
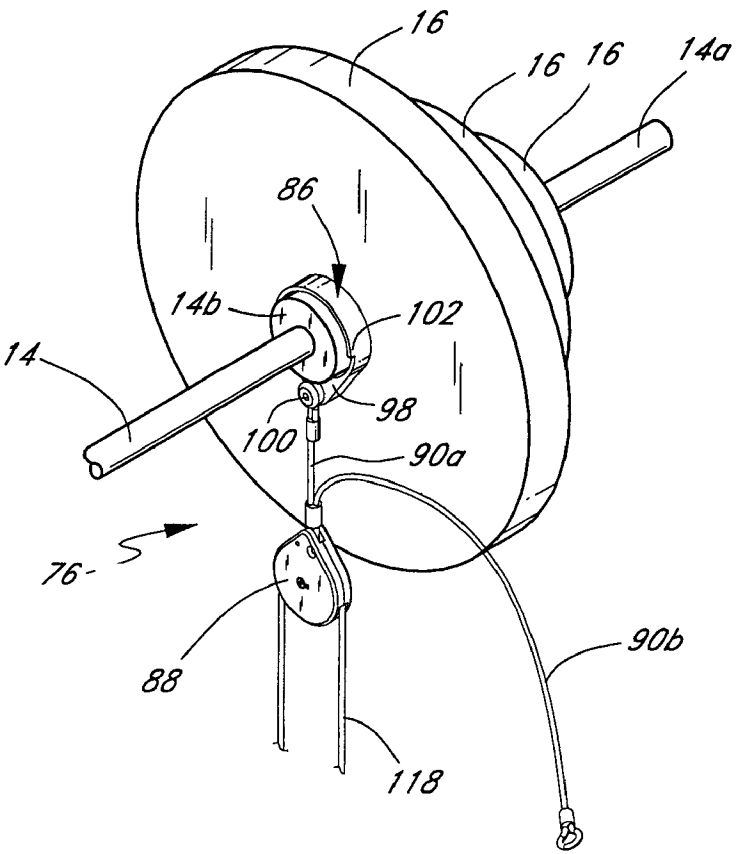
FIG. 6 is an enlarged view of one side of a weight-lifting bar used with the exercise apparatus of FIG. 1 and illustrates a coupling between the pneumatic resistance unit of the exercise apparatus and the weight-lifting bar.

In the embodiment described herein, as best seen in FIG. 6, the coupler 76 takes the form of a collar 86 that fits onto the weight bar 14. The coupler 76, however, can take other forms and can serve to couple the resistance unit 18 either to other types of user interfaces or exercise equipment or directly to a user. For example, the coupler can be a band (preferably of an adjustable size) that is sized to fit around a portion of the user's body, e.g., a waistband or an ankle band. The coupler can also be configured to couple to a bar, a foot pedal, or other lifting equipment. The coupler thus can be any type of connector that couples to an article or mechanism that a user acts against or interacts with and that is attached, either directly or indirectly, to the extension mechanism 78.

The coupler 76 preferably is moved between two positions during an exercise and can be moved from one extreme position to another extreme position. In the illustrated embodiment, the coupler 76 normally resides in a retracted position when detached from the weight bar 14. When attached, a user can move the weight bar 14, and thus the coupler 76, from the retracted position to an extended position in which the cable of extension mechanism 78 is pulled to its farthest position from the housing 84. The exercise movement can involve movement between any two positions between (and possibly including) the retracted and extended positions in order to accommodate different exercises and different size weight lifters.

Figure 7:
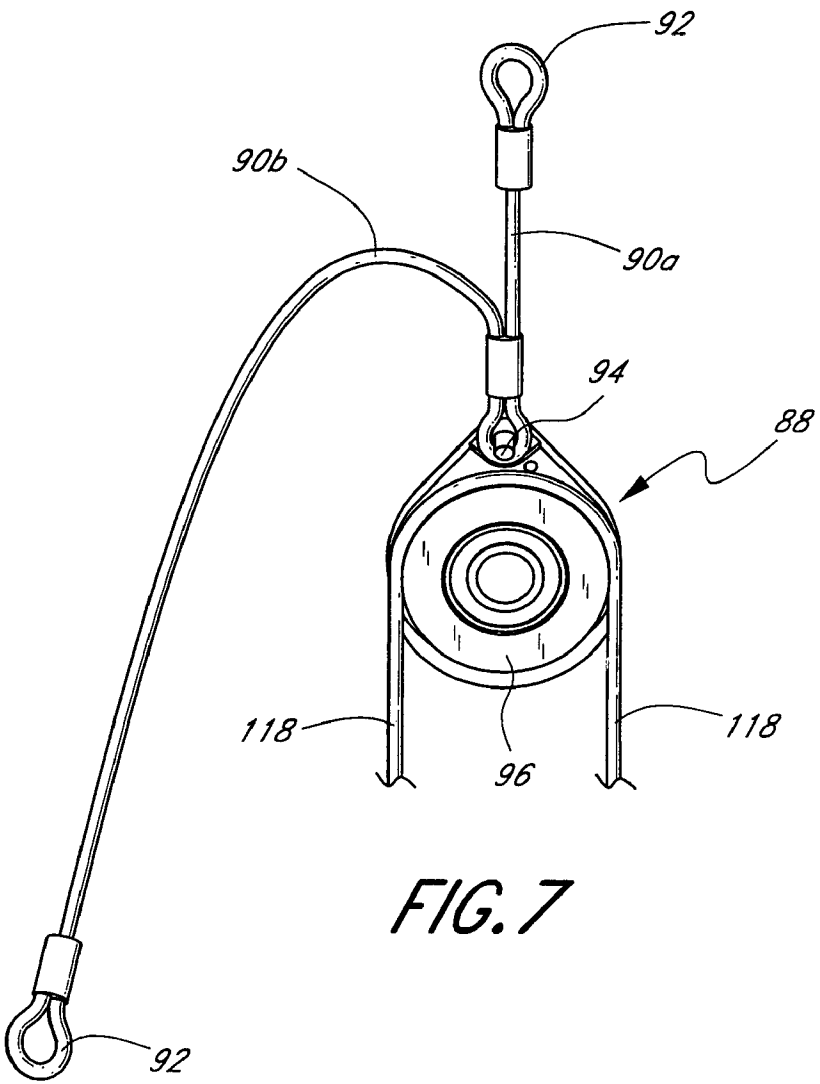
FIG. 7 is a perspective view of the coupling with a portion of a body of the coupling removed to illustrate the internal components of the coupling.

In the illustrated embodiment, as seen in FIGS. 6 and 7, the coupler 76 may also include a body 88 from which one or more lengths of cable 90*a*, 90*b* extend. The purpose of the different lengths of cable 90*a*, 90*b* will be described below. Each length of cable 90*a*, 90*b* includes a loop 92 at its outer end. As best seen in FIG. 7, the two lengths of cable 90*a*, 90*b* in the illustrated embodiment are formed from a single cable. The cable is threaded through an opening in the top of the body 88, around an internal pin 94 and back out the opening. The two sections of cable are crimped together at a point near the body 88 so as to define two distinct and different lengths of cables 90*a*, 90*b* that extend from the body 88. The loops 92 on each cable section end can also be formed by looping the ends of the cable back onto themselves and crimping them, as illustrated in FIG. 7.

In a preferred embodiment, a first cable section has a length of about 4 inches while a second cable section has a length of about 20 inches. The shorter length is preferred when working lower on the apparatus (for example, when bench pressing), while the longer length is preferred when working higher on the apparatus (for example, when doing standing military presses). The combination of the longer cable section and the travel of the extension member preferably equals or exceeds the height within the frame 12. For example, where the frame has an inner height of 100.5 inches, and the extension member has an extension of 72 inches, the longer cable section preferably has a length of 28.5 inches. In this manner, the pneumatic resistance units 18 can be connected to the weight bar 14 for use at various heights relative to the frame 12.

The body 88 also supports a pulley 96 that rotates about an axis located below the pin 94. The body 88 preferably surrounds a sufficient portion of the pulley 96 so as to prevent a cable of the extension mechanism 78, which is wound through the pulley 96, from disconnecting from the pulley 96 during use.

The collar 86 of each coupler 76 preferably has a generally cylindrical shape with a through hole sized to fit over the respective sleeve 14*a* of the weight bar 14. The diameter of the through hole preferably matches the diameter of the hole through the weight plates 16 that are used with the weight bar 14. For example, when used with Ivonko™ weight bars, the through hole has a diameter of 50 mm.

The collar 86 may also include a counter-bore on its inner side (i.e., on the side located closer to the longitudinal middle of the weight bar 14 when the collar 86 is attached thereon). The counter-bore has a diameter slightly larger than the diameter of a hub 14*b* on the weight bar 14, as seen in FIG. 6. The depth of the counter-bore preferably is less than the width of the weight bar hub 14*b*.

A flange 98 extends from one side of the collar 86 and supports a knob 100 on the inner side of the collar 86. The knob 100 has a sufficient size to hold one of the cable sections 90 on the collar 86 when the loop 92 on the outer end of the cable section 90 is slipped over the knob 100. The relative positions of the flange 98, the knob 100 and the bottom of the counter-bore preferably are selected to locate the cable section 90 generally at a longitudinal midpoint of the weight bar hub 14*b* and generally over the track assembly 52.

In order to achieve this arrangement while increasing the overall strength of the collar 86, the collar 86 may also include an arched section 102 that extends above the knob 100. In the illustrated embodiment, the arched section 102 extends approximately 180° around an axis of the collar 86 and has a width (as measured along the longitudinal axis of the weight bar 14) slightly greater than the distance by which the knob 100 protrudes from the flange 98.

Each coupler 76 thus links the respective extension mechanism 78 to the weight bar 14 when a user slips the collar 86 over the sleeve 14*a* of the weight bar 14 and attaches the body 88 to the collar 86 by connecting one of the cable lengths 90*a*, 90*b* to the collar 86. The cable 90*a* or 90*b* transfers movement of the weight bar 14 to the body 88, which, in turn, acts on a cable of the extension mechanism 78 that extends from the housing 84.

Figure 5:
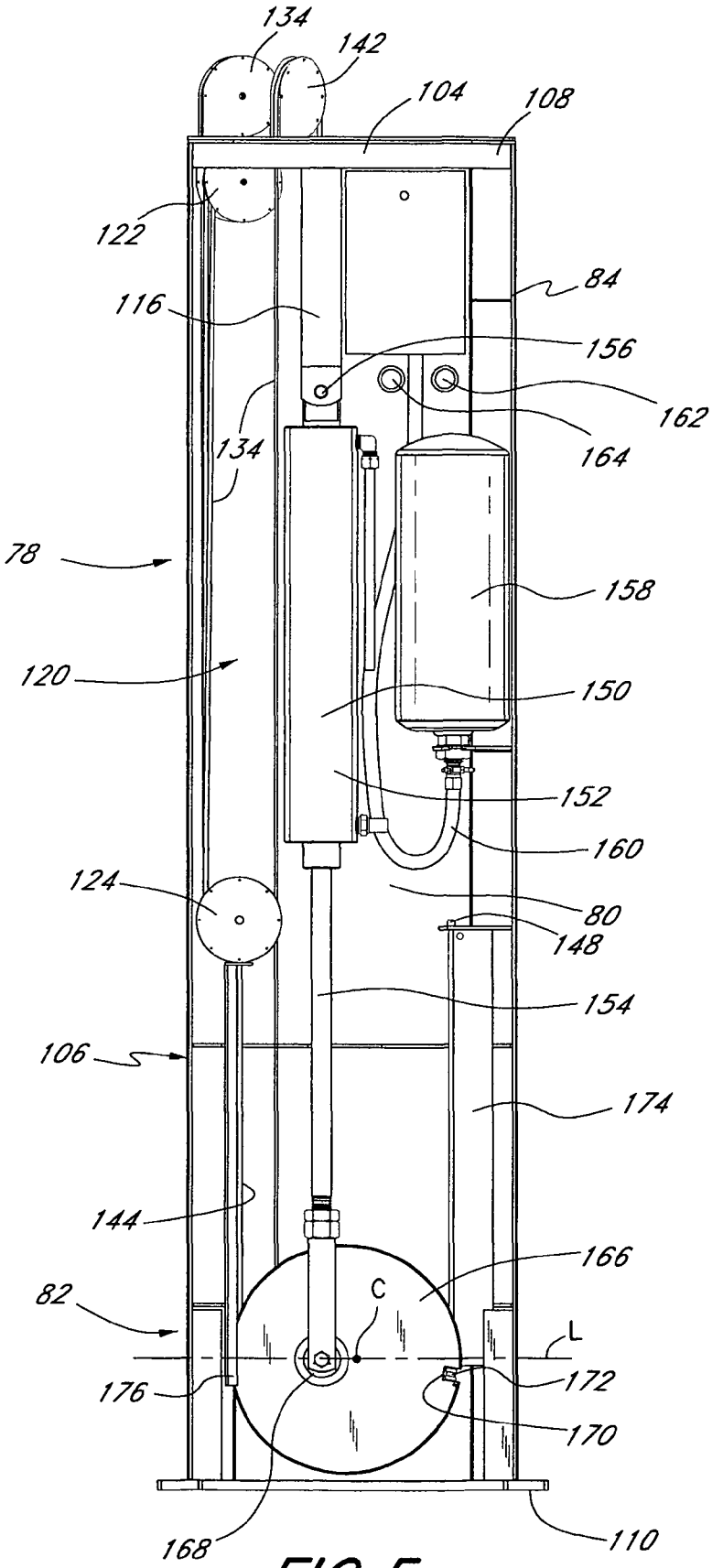
FIG. 5 is a front elevational view of a pneumatic resistance unit of the exercise apparatus of FIG. 1; a front cover panel of the pneumatic resistance unit has been removed to expose the internal components of the pneumatic resistance unit.

As seen in FIGS. 1 and 5, the housing 84 is substantially rigid and is defined by a frame 104 and a cover assembly 106. The frame 104 of the illustrated embodiment, as best seen in FIG. 5, includes an upper cross member 108 and a lower base member 110 that are connected together by a stationary panel 112 of the cover assembly 106. A removable cover panel 114 (see FIG. 1) is disposed on the other side (front side) of the resistance unit 18. This panel 114 has been removed in FIG. 5 to expose the components of the pneumatic resistance unit 18 that are disposed within the housing 84. A plurality of internal ribs and brackets are attached to the stationary panel 112, upper cross member 108 and lower base member 110 in order to support various components of the extension mechanism 78, the coupling mechanism 82, and the resistance assembly 80, as well as any electronic controls for the resistance unit 18. The ribs not only increase the rigidity of the housing 84 but also include holes through which a cable of the extension mechanism 78 may pass in order to ensure that the cable maintains its position within the housing 84. Additionally, as best seen in FIG. 5, a cylinder-mounting bar 116 depends from the upper cross member 108. The cylinder-mounting bar 116 preferably is disposed at a position slightly offset from a central vertical plane.

Preferably, the resistance units 18 are generally mirror images of each other. FIG. 5 illustrates the arrangement of the components within the housing 84 for the resistance unit 18 illustrated on the left side of the frame 12, as viewed from the perspective shown in FIG. 1. The layout of the components within the housing of the right-side resistance unit should be understood to be a mirror image of what is shown in FIG. 5, except where noted otherwise.

Fastener (not shown) preferably connect the removable cover panel 114 to the stationary cover 112. The interior of the unit 18 can be opened for servicing or inspection by removing the fasteners and removing the cover panel 114.

The lower base member 110 of the housing 84 may be attached to the corresponding mounting platform 26 on the left side of the frame 12. Similarly, the lower base member of the housing for the right side resistance unit 18 may be attached to the corresponding mounting platform 26 on the right side of the frame 12. In this manner, the resistance units 18 can be sold or shipped apart from the frame 12, and subsequently easily and rigidly affixed to the frame 12. Suitable fasteners or fastening techniques (e.g., bolts, welding, etc.) can be used to attach, either permanently or removably, the resistance units 18 to the frame 14.

The extension mechanism 78 resides in part within the housing 84 and is extendable from the housing 84 during an exercise stroke. For this purpose, as seen in FIG. 3, a section of cable 118 (a "user cable") of the extension mechanism 78 is threaded between the pulleys 66 of the trolley 52, which serve as guide members for the cable 118, and about the pulley 96 of the coupler 76. In this manner, the coupler 76 is connected to the extendable user cable 118.

As used herein, "cable," means collectively, steel or fiber rope, cord, or the like. For example, the user cable 118 can be a formed of a synthetic material, such as a polymer. One suitable example for the user cable is a polyester/nylon blend rope; however, a coated steel cable can also be used. For example, the user cable may comprise ⅛-inch wire cable with a plastic sheathing, and the pulleys that support the cable can have a diameter of about five inches. Although any suitable cable and pulley size can be employed, it is preferable that the associated pulleys have a diameter about 40 times the diameter of the coated-wire cable.

As best seen in FIG. 5, the extension mechanism 76 includes a block-and-tackle mechanism 120 disposed within the housing 84. The block-and-tackle mechanism 120 includes an upper pulley block 122 and a lower pulley block 124. In the illustrated embodiment, the upper pulley block 122 includes two pulleys 125, and the lower pulley block 124 includes two pulleys 126. However, each block 122, 124 can include fewer or more pulleys, and the number of pulleys on each pulley block can differ according to the application. In the illustrated embodiment, the lower pulley block 124 constitutes an output member of the block-and-tackle mechanism 120. Of course, in other embodiments, the upper pulley block 122 may fill this role instead.

Figure 5A:
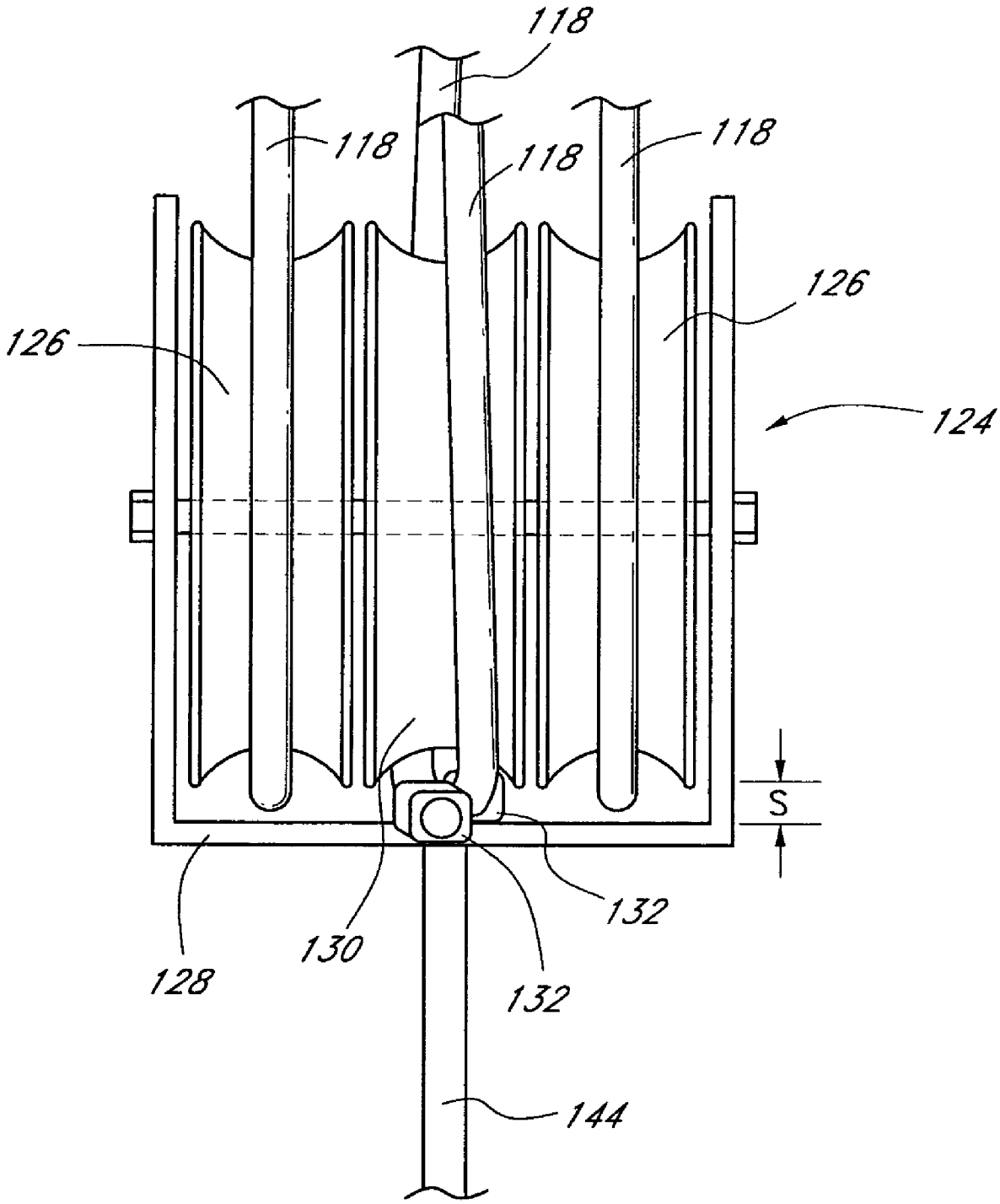
FIG. 5A is an enlarged side elevational view of a pulley block in the pneumatic resistance unit of FIG. 5.

As seen in FIG. 5A, a U-shaped bracket 128 of the lower pulley block 124 preferably covers the ends of the pulleys 126 of the lower pulley block 124 and extends below the pulleys 126. The spacing S between the lower portion of the bracket 128 and the pulleys 126 allows for the free rotation of the pulleys 126, yet inhibits the cable 118 from disconnecting from the pulleys 126.

In the illustrated embodiment, the lower pulley block 124 also includes a spacer 130 between the two pulleys 126. The two ends of the user cable 118 preferably are fixed relative the spacer 130. In the illustrated embodiment, the spacer 130 is a "dead" pulley that lies between the two active pulleys 126 of the lower pulley block 124. Crimps 132 are attached to both ends of the user cable 118. The crimps 132 are larger than the spacing S between the lower portion of the bracket 128 and the spacer 130 to prevent the ends of the user cable 118 from being pulled through the block-and-tackle mechanism 120. In one embodiment, one side of the user cable 118 extends from the spacer 130 upward toward one of the pulleys 125 of the upper pulley block 122, and the other side of the user cable 118 extends from the spacer 130 upward toward the other pulley 125 of the upper pulley block 122.

Figure 8:
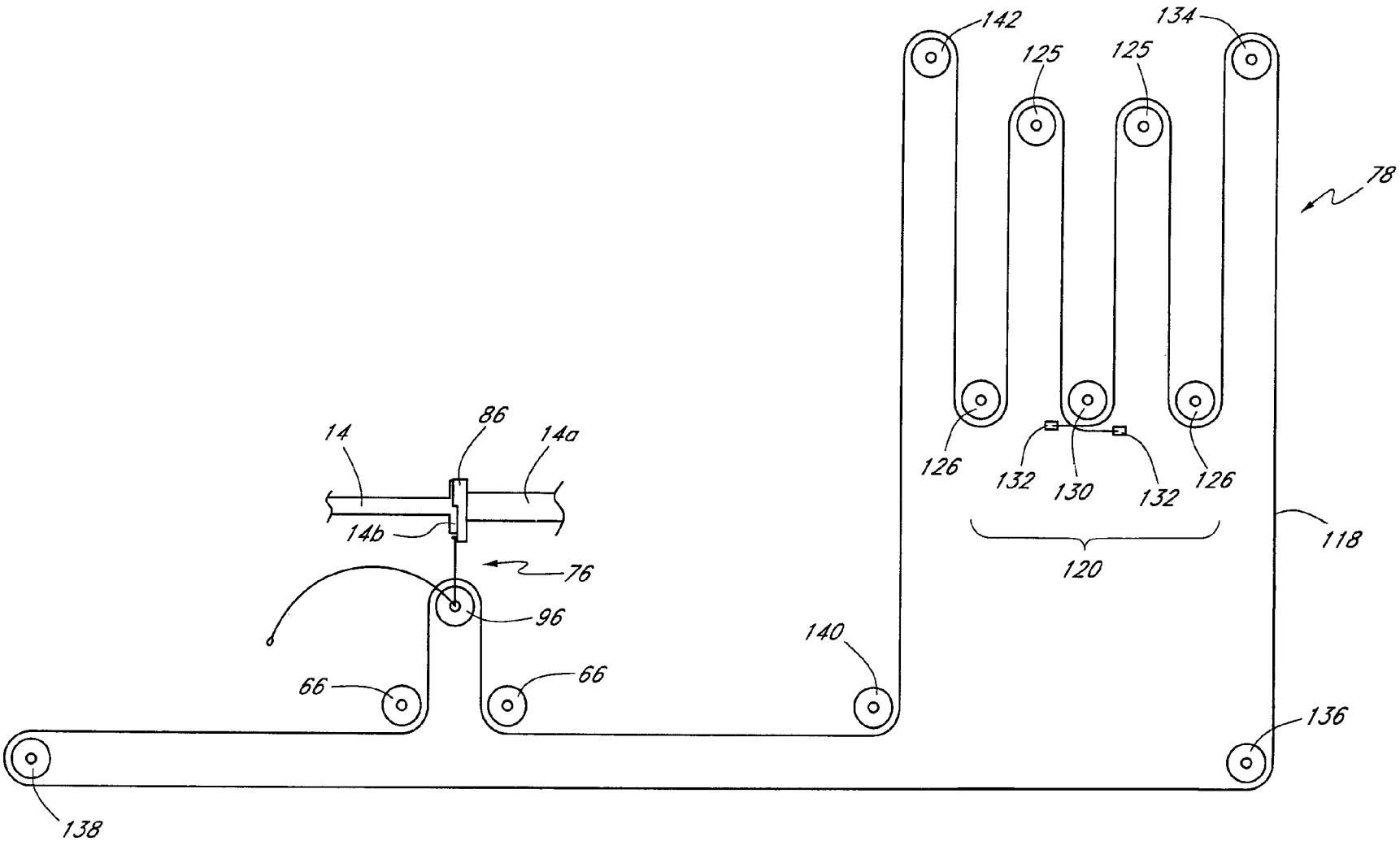
FIG. 8 is a schematic diagram of a cable path through the pneumatic resistance unit, the track assembly and the coupler.

As seen in FIGS. 5 and 8, each side of the user cable 118 extends downward from the respective upper pulley 125 and wraps around a respective lower pulley 126 of the lower pulley block 124. Each side of the cable 118 then extends upward again to pass around additional pulleys of the resistance unit 18, as will be described. Accordingly, as the user pulls the user cable 118 from the housing 84 (i.e., pulls a portion of the cable 118 toward an extended position), the block-in-tackle mechanism 120 shortens as the lower pulley block 124 moves upward toward the upper pulley block 122.

In the present embodiment, the upper pulley block 122 is attached to upper cross member or bracket 108 of the frame 104. The lower pulley block 124 is suspended below the upper pulley block 122 by the user cable 118. The rotational axes of the upper and lower pulley blocks 126 are preferably skewed relative to each other so that the cable 118 coming off the pulleys 125 of the upper pulley block 122 will align with the pulleys 126 of the lower pulley block 124. In the illustrated embodiment, the rotational axes of the lower pulleys 126 are arranged generally normal to the stationary cover panel 112, while the rotational axes of the upper pulleys 125 are skewed relative to the rotational axis of the lower pulleys 126. This arrangement aligns one side of each upper pulley 125 with the spacer 130 and the other side of each upper pulley 125 with one of the lower pulleys 126.

As understood from FIGS. 3, 5 and 8, the user cable 118 engages additional pulleys as it extends between the pneumatic resistance unit 18 and the trolley 52. FIG. 8 schematically illustrates the path of the user cable 118. As noted above, one end of the cable 118 includes a crimp 132 to effectively fix that end to the lower pulley block 124. The cable 118 extends up from the lower pulley block 124, around a pulley 125 of the upper pulley block 122 and downward around a pulley 126 of the lower pulley block 124. The cable 118 then extends upward from the lower pulley block 124, around a first upper pulley 134 (which is located at the top of the housing 84 as seen in FIG. 5), and then back downward though the housing 84 to a first lower pulley 136. As seen in FIGS. 1 and 3, the first lower pulley 136 is supported by the housing 84 and is arranged such that the cable 118 exits the bottom of the housing 84 in a direction generally parallel to the track 54 (which in the illustrated embodiment is also normal to the housing stationary panel 112). The first lower pulley 136 is also preferably arranged such that the user cable 118 extends along a lower side of the track 54.

The user cable 118 extends around an end pulley 138 that preferably is located near an opposite end of the track 54 to position the cable 118 on the upper side of the track 54. This section of the user cable 118 extends to one of the pulleys 66 of the trolley 52. From the trolley 52, the cable 118 loops around the coupler pulley 96 and then passes beneath the other trolley pulley 66, as seen in FIG. 8. A second lower pulley 140 guides the user cable 118 back into and upward within the housing 84. (The resistance mechanism 80 hides this section of the cable 118 in FIG. 5.) The user cable 118 passes through the top of the housing 84, around a second upper pulley 142 and then extends back into the housing 84 to the other pulley 126 of the lower pulley block 124. After wrapping around the pulley 126, the cable 118 extends upward, around the other pulley 125 of the upper pulley block 122 and then downward where it terminates at its other crimped and fixed end on the other side of the spacer 130.

As illustrated in FIGS. 5 and 5A, the coupling mechanism 82 in the illustrated embodiment includes a main cable 144. A first end 146 of the main cable 144 is attached to the bracket 128 of lower pulley block 124. The second end 148 of the main cable 144 is fixed to the housing 84. The main cable 144 cooperates with the resistance assembly 80 through the main pulley 166. As the user pulls the coupler 76, the user cable 118 winds through the pulley blocks 122, 124, lifting the lower pulley block 124 and correspondingly pulling on the main cable 144. Force from the resistance assembly 80 is communicated through the main cable 144 to the lower pulley block 124 and further to the user cable 118 to resist the coupler's 76 motion.

In the illustrated embodiment, the block-and-tackle mechanism 120 is arranged with four pulleys and six lengths of line between the pulleys, and is structured such that a force pulls on both ends of the cable. As such, the block-and-tackle mechanism provide generally a 3-to-1 mechanical advantage over any resistance force, and the stroke length of coupler 76 is about three times the stroke length of the pulley blocks (i.e., the distance between the upper and lower pulley blocks 122, 124 when the coupler 76 is in the retracted position). Of course, any pulley assembly can be used to achieve any desired force reduction or stroke elongation. Indeed, in other applications, it may be desirable to use a simpler cable assembly to transmit pneumatic resistance to the coupler 76.

The resistance assembly 80 of the illustrated embodiment includes a pneumatic actuator 150. In one embodiment, the pneumatic actuator 150 is a linear actuator that includes a cylinder 152 and a piston rod 154. The cylinder 152 includes a cylinder body and a piston that slides within the cylinder body. The piston divides the cylinder body into two variable volume chambers. At least one of the chambers only selectively communicates with the atmosphere, thereby providing pneumatic resistance. The other chamber may open to the atmosphere. In other applications, both chambers can be pressurized (e.g., be of equal pressure), can selectively communicate with the atmosphere and/or can communicate with each other. In the illustrated embodiment, however, one of the chambers communicates with the atmosphere (e.g., the air within the housing) so as not to resist movement of the piston.

The piston rod 154 is connected to the piston and extends through one of the variable volume chambers. The piston rod 154 moves linearly along a stroke axis as the piston slides within the cylinder bore. The stroke length of the piston rod 154 is sufficient to provide the desired stroke for the block-and-tackle mechanism 120 (as discussed above).

In one embodiment, a cap closes the end of the cylinder body opposite the end through which the piston rod extends. The cap includes a lug. A pivot pin 156 preferably secures the lug to the cylinder-mounting bar 116 such that the pneumatic actuator 150 can pivot within the housing 84 about the pivot pin 156. The pneumatic actuator 150 in the illustrated embodiment can pivot within a plane that is generally parallel to the stationary panel 112 of the housing 84. However, in other applications, the cylinder body can be rigidly fixed within the housing 84 or may pivot about a different axis or axes. As a naming convention, we may refer to an upper chamber and a lower chamber of the vertically oriented pneumatic actuator 150. In the illustrated embodiment, the lower chamber is open to the atmosphere (preferably through a filter), and the upper chamber is pressurized.

At least several components of the pneumatic actuator 150 are preferably formed of a polymer (e.g., plastic) in order to lighten the weight of the resistance unit 18 and to decrease production costs. Such components can include the cylinder body, the piston and one or more of the end caps of the cylinder.

The upper chamber preferably communicates with at least one accumulator 158, as seen in FIG. 5. The accumulator 158 is preferably rigidly mounted within the housing 84 at a location next to the cylinder 152. In the illustrated embodiment, the accumulator 158 is mounted on one side of the cylinder 152, and the block-and-tackle mechanism 120 is disposed on the other side of the cylinder 152. An air equalization line 160 connects the accumulator 158 with the cylinder 152 so as to expand the effective volume of the upper chamber. Thus, the air pressure resisting the piston rod's 154 motion will not increase as dramatically when the piston is moved.

Figure 9:
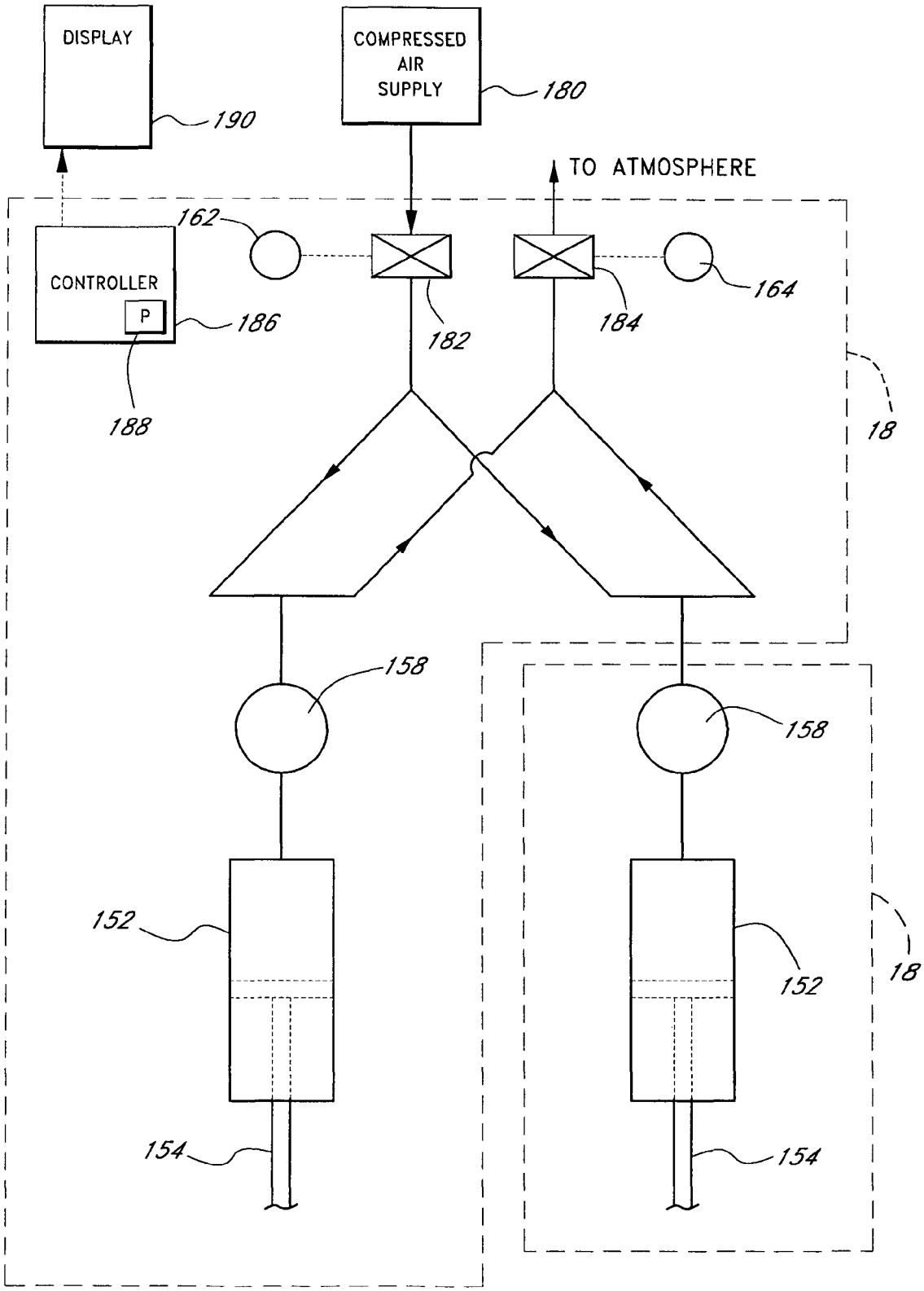
FIG. 9 is a schematic diagram of the pneumatic and electrical circuits of the exercise apparatus of FIG. 1.

The accumulator 158 and the upper chamber also selectively communicate with a source of pressurized air and/or with the atmosphere. As shown in FIG. 9, an air compressor 180, which can be remotely disposed relative to the exercise apparatus, communicates with the upper chamber or accumulator 158 through an inlet valve 182. As best seen in FIG. 5, a button 162 that actuates the inlet valve 182 is preferably accessible from the front side of the housing 84 and is marked with appropriate indicia (e.g., "+"). Pushing the button 162 increases the air pressure in the charged side of the cylinder 152, i.e., the upper chamber in the illustrated embodiment. An outlet valve 184 communicates with the charged side of the cylinder 152 to selectively expel air to the atmosphere in order to decrease the air pressure in the charged side of the cylinder 152. A button 164 that actuates the outlet valve 184 also is preferably accessible from the front side of housing 84 and is marked with appropriate indicia (e.g., "−"). A user thus can adjust, i.e., increase or decrease, the air pressure within the resistance assembly 80 by pressing the appropriate button and thereby operating the appropriate valves. The control buttons 162, 164 may be included on only one of the resistance unit housings 84 (e.g., the left resistance housing in the illustrated embodiment), as described below.

In another embodiment, illustrated in FIGS. 10A-10D, a different frame is shown in combination with many of the features described above. In addition, this embodiment includes a pair of foot actuators 200, 202, which are preferably attached to corresponding base members 20, and which provide similar functionality to that provided by the buttons 162, 164, respectively, on the resistance unit housing 84. The foot actuators 200, 202 may each comprise a foot plate 204 coupled to a hinge pin 206. The hinge pin 206 is supported by and rotatable within a hinge support, such that the foot plate 204 and hinge pin 206 can rotate relative to the hinge support and base member 20. A shaft 208 is coupled with (e.g., welded to or integrally formed with) the foot plate 204 and hinge pin 206 and is configured to rotate with them. A bearing block 218 provides support to the shaft 208, while allowing generally free rotation of said shaft 208. A lever 210 extends from the shaft 208 generally in a radial direction. An outer end of the lever 210 is connected to a spring 212. The spring 212 is further coupled to the resistance unit 18, and the interaction between the spring 212 and lever 210 biases the foot plate 204 towards an un-depressed position (i.e., an orientation in which the foot plate 204 lies generally parallel to the ground). While a spring/lever mechanism is used in the illustrated embodiment to bias the foot actuator toward its un-actuated position, other biasing devices (e.g., a torsion spring) may also be used. A cam 214 is also attached to the shaft 208 and may rotate into engagement with a button 216, which is connected to a pneumatic supply and control system (described in further detail below), to charge or discharge the cylinders 152. The foot actuators can also be configured differently than shown. For example, the foot actuators 200, 202 can have different shapes and sizes than the illustrated actuators and can take other forms, such as, for example, a pair of buttons that are activated by depression, in a manner similar to the buttons 162, 164.

In the illustrated embodiment, a hinge pin 206 supported by a hinge support lies along the base member 20, with the foot plate 204 extending from near the hinge pin 206 towards an interior of the apparatus 10. In an un-depressed position, as shown in FIG. 10A, the foot plate 204 lies generally parallel to the ground, although the biased or un-depressed position may be different in other embodiments.

Figure 10B:
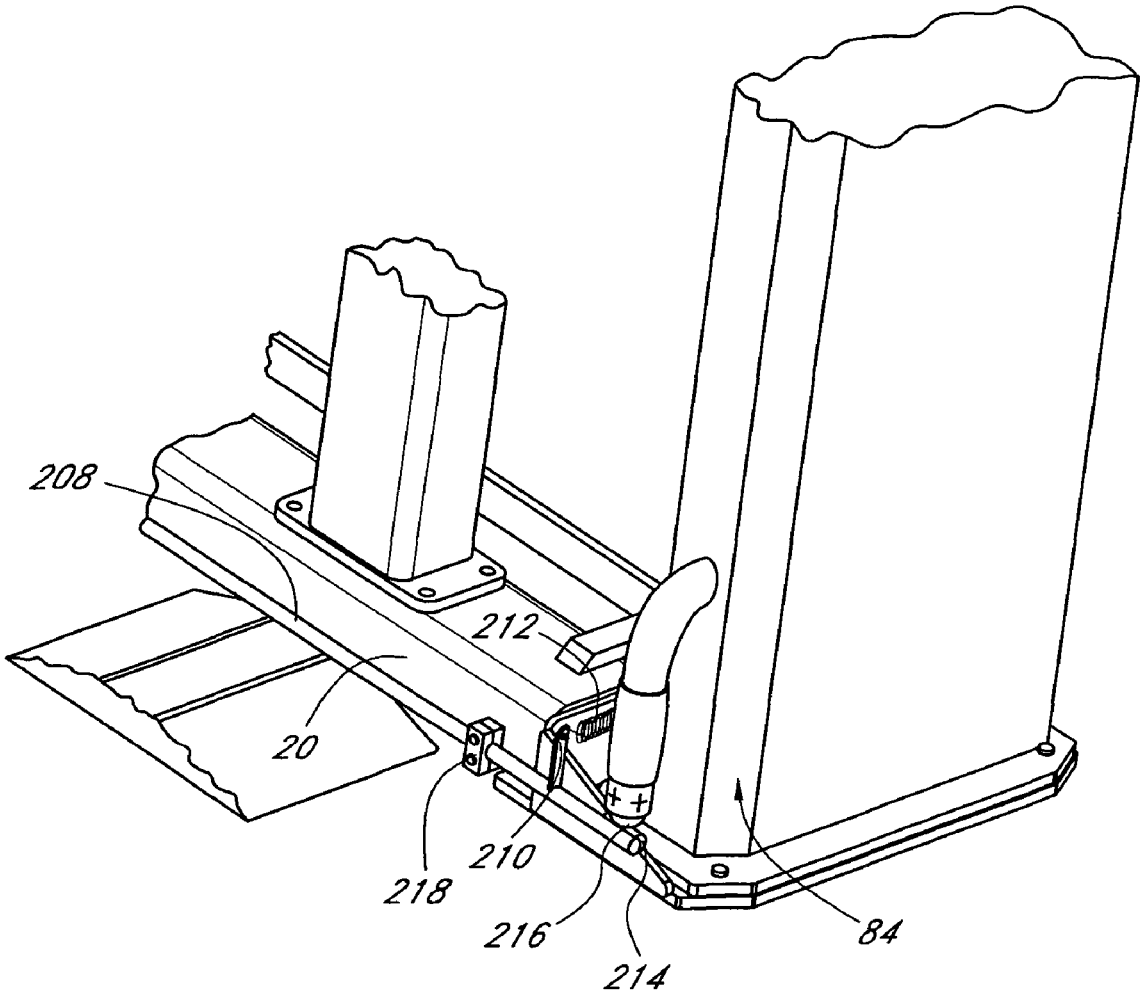
FIG. 10B is a perspective view that illustrates an end of one of the actuators.
Figure 10C:
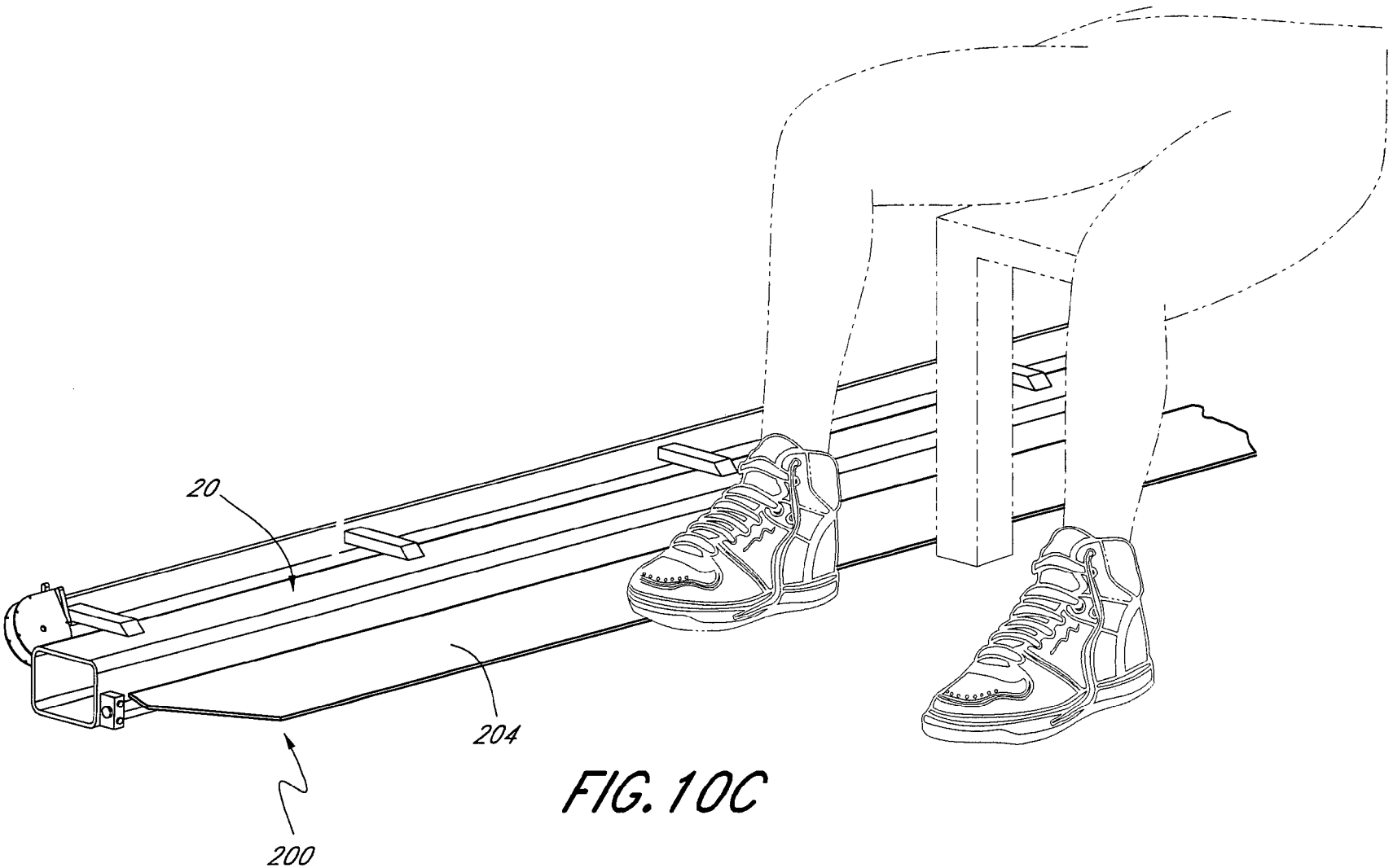
FIG. 10C is a perspective, close-up view of the exercise apparatus depicted in FIG. 10A. In this view, a user's right foot is positioned on an actuator plate of the other actuator.
Figure 10D:
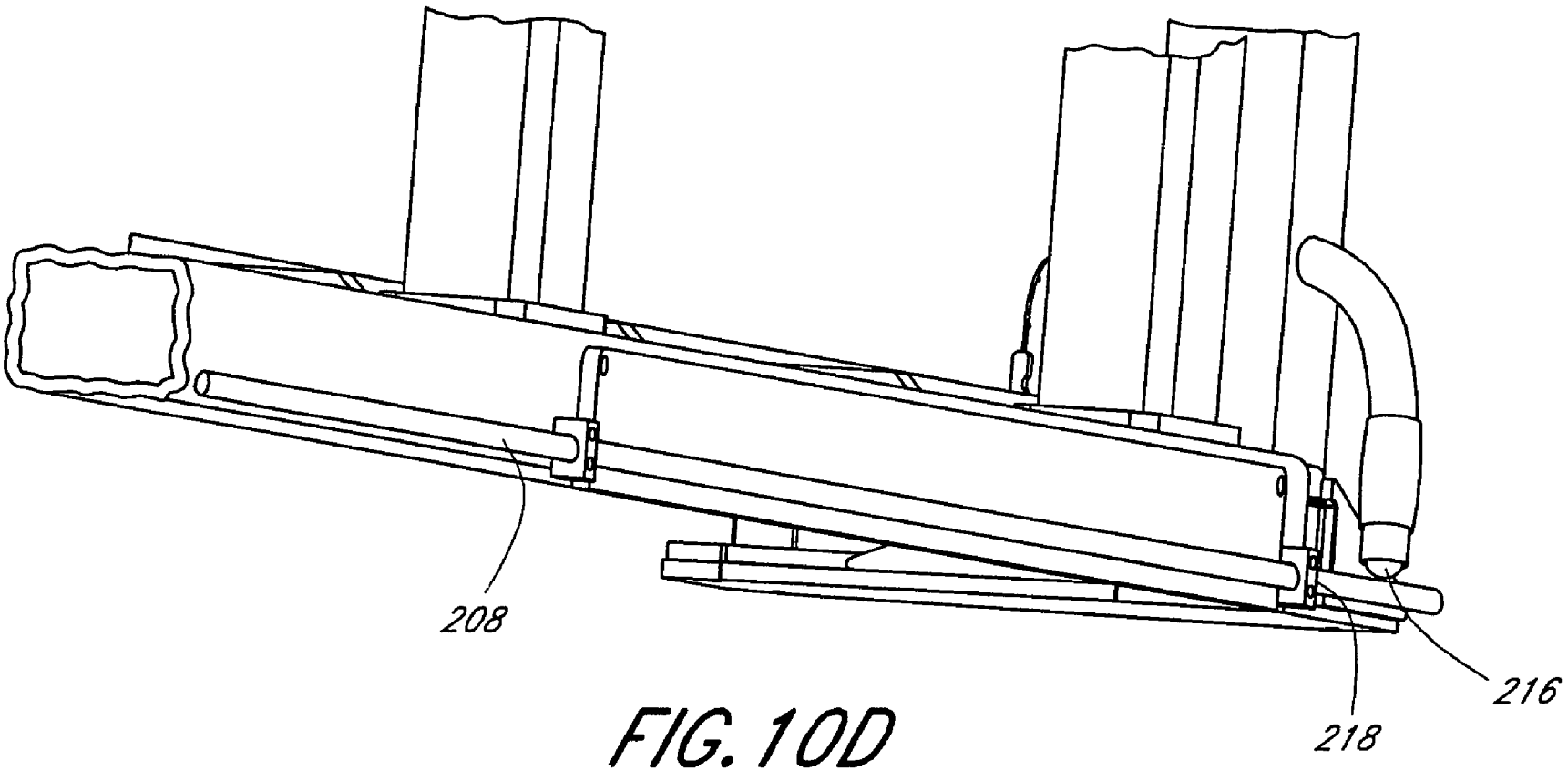
FIG. 10D is a side perspective view showing a portion of one of the actuators generally. The Figure depicts a shaft extending from the respective actuator plate and to a point near a portion of the pneumatic resistance device. As also seen in FIG. 10B, the shaft includes a cam surface that cooperates with a control button when the shaft rotates with depression of the corresponding actuator plate.

In a preferred embodiment, in order to actuate the foot actuators 200, 202, the foot plate 204 is rotated about the hinge pin 206 towards the ground. From an exerciser's point of view, when the right foot plate 204 is depressed, as shown in FIG. 10C, the inlet valve 182 is actuated, and air pressure is added to the charged side of the cylinder 152. When the left foot plate 204 is depressed (not shown), the outlet valve 184 is actuated, and air pressure is released from the charged side of the cylinder 152. In one embodiment, the foot actuators 200, 202 are redundant, providing precisely the same functionality as the buttons 162, 164. In other embodiments, the foot actuators 200, 202 may provide slightly different rates or ranges of charging and discharging the cylinders, or may be the sole means of adjusting the air pressure on the charged side of the cylinder 152.

In a preferred embodiment, the shaft 208 serves to transmit the foot plates' depression to the button 216, which is located near the housing 84. The shaft 208 is illustrated as extending generally parallel to the base members 20 along the interior of the apparatus 10. In other embodiments, however, other orientations and locations for the shaft 208 may be chosen. For example, the shaft 208 may run along the top of a base member 20 to prevent a user from accidentally activating one of the valves. The shaft 208 is secured to the apparatus 10 by a bearing block 218. This bearing block 218 provides support to the shaft 208 and also provides a surface about which the shaft 208 can rotate relatively freely. Other means of rotatably supporting the shaft, which are well known to those of skill in the art, can also be used.

As illustrated in FIG. 10C, the shaft 208 is rotated as the foot plate 204 is depressed. In FIG. 10B, a portion of the shaft 208 that lies adjacent the housing 84 is shown in greater detail. The lever 210 is fixed with respect to the shaft 208, such that the lever's rotation reflects the rotation of the shaft 208 and in turn the orientation of the foot plate 204. The lever 210 is biased in the direction of the housing 84 by the spring 212, thus biasing the foot plate 204 into its un-depressed position. Upon depression of a foot plate 204, this spring force is overcome, and the shaft 208 is rotated such that the lever 210 moves away from the housing 84. As the shaft 208 rotates with the depression of the foot plate 204, the cam 214 on the shaft 214 moves away from the housing 84 into engagement with the button 216. In the preferred embodiment, shown in FIG. 10B with reference to foot actuator 200, the button 216 functions identically to the button 162, such that upon depression the inlet valve 182 is actuated. When the force on the foot plate 204 is removed, the spring force rotates the shaft 208, and the cam 214 rotates out of engagement with the button 216, thereby preventing further charging of the cylinders. Although the buttons 216 are illustrated in positions proximal to the pneumatic resistance units 18, other configurations and positions are possible. In one embodiment, the button 216 is located farther from the resistance unit 18 and sends an electronic signal along the base member 20 to the unit. In other embodiments, other means of transmitting the signal from the foot plates 204 may be used, including electronic, wireless and other mechanical means well known to those of skill in the art.

Although the foot actuators 200, 202 are shown attached to corresponding base members 20, the apparatus 10 may be configured with other actuator locations to facilitate use by the exerciser. For example, one or multiple hand actuators may be placed near the bar catches 32 to be within easy reach of a user in an exercise position. Other configurations are also possible, including use of two foot actuators that lie along the same base member 20 on one side of the user. In another embodiment, only one foot actuator may be provided. This foot actuator may duplicate the functionality of both buttons 162, 164, or of one of the buttons. For example, a single foot actuator could be used to decrease the air pressure on the charged side of the cylinder 152 in a manner similar to button 164.

Returning to a discussion of the internals of the housing 84 illustrated in FIG. 5, the coupling mechanism 82 transfers a resistant force from the resistance assembly 80 to the extension mechanism 78 to oppose movement of the coupler 76 on the weight bar 14 by the user. As noted above, the coupling mechanism 82 includes the main cable 144 that is pivotally fixed at its first end 146 to the lower pulley block 124 and is rigidly fixed at its second end 148 to the housing 84. For this purpose, the main cable 144, in the illustrated embodiment, includes a ball swaged onto the first end 146. The ball fits through a keyway slot formed in the lower pulley block 124 and nests in a receptacle (not shown). The receptacle/ball connection secures the first end 146 of the main cable 144 to the lower pulley block 124, yet allows the cable 144 to pivot relative to the pulley block 124. Of course, other means of providing such a pivotal attachment are well known to those of skill in the art.

The coupling mechanism 82 also includes a main pulley or pulley wheel 166 that preferably is circular and has a larger diameter than the pulleys of the block-and-tackle mechanism 120. The main pulley 166 is rotatably attached to the end of the piston rod 154 to permit rotation of the main pulley 166 relative to the piston rod 154. For this purpose, the main pulley 166 includes a bearing 168, at which a piston rod end couples to the pulley 166 by a bolt or pivot shaft. A cable channel is disposed about the periphery of the main pulley 166, and the main cable 144 fits therein.

With reference to FIG. 5, a cable lock notch 170 is disposed along the peripheral edge of the main pulley 166. In the illustrated embodiment, the cable lock notch 170 is configured at the point that will provide a sufficient amount of the main cable 144 to unwind from the main pulley 166 to accommodate the stroke length of the piston rod 154. A cable lock member 172 is disposed about the main cable 144 and fits into the cable lock notch 170. In this manner, the position of the main cable 144 relative to the main pulley 166 is maintained.

A guide preferably is provided next to the pulley wheel 166 and is arranged such that the pulley wheel rides along the guide. In the illustrated embodiment, the guide is an elongate cable support member 174 that extends inwardly from a first side of the housing 84, which is farthest from the extension mechanism (e.g., the left side, as viewed from the front, in the illustrated embodiment). The guide, however, need not in all applications support the cable 144 or hold the cable 144 within the peripheral channel of the main pulley 166.

The cable support member 174 is positioned immediately adjacent the downwardly extending portion of the main cable 144 attached to the housing 84. The cable support member 174 preferably has a thickness that is about equal to the diameter of the cable 144 and is thin enough to fit at least partially within the peripheral channel of the main pulley 166. As the main pulley 166 is drawn upwardly, it travels along the cable 144 and the support member 174. The support member 174 thus prevents any substantially "play" in the coupling mechanism 82 that might otherwise occur and, in fact, helps hold the main pulley 166 securely in place during operation of the apparatus. Since the cable 144 generally does not slide relative to the cable support member 174, wear of the cable 144 and the pulley 166 is substantially lessened.

With continued reference to FIG. 5, a cable cover 176 preferably extends from a second side of the housing 84. The cable cover 176 principally functions to guide the pulley wheel 166. In addition, the peripheral edge of the main pulley 166 preferably fits within the cover 176, so that the cover 176 can help the main pulley 166 remain properly aligned. However, the cable cover 176 should not contact or support the main pulley 166 or the main cable 144.

As understood from FIG. 5, a first section of the main cable 144 extends from the main pulley 166 toward the first cable end 146, and a second section of the main cable 144 extends from the main pulley 166 toward the second cable end 148. In the illustrated embodiment, each of the first and second cable sections has a generally vertical orientation. The pneumatic actuator 150 is arranged such that its stroke axis lies generally parallel to the first section of the main cable 144 when the extension mechanism 78 is in its retracted position.

As discussed above, it can be expected that, as the piston moves within the cylinder 152, the resistance force will increase somewhat, although not as dramatically as it would without the accumulator 158. For some exercises, it is preferred that the resistance force be maintained at a more constant level throughout the exercise stroke. As discussed below, the illustrated embodiment further comprises a mechanism for controlling the resistance force over the stroke of the piston rod 154; however, the pneumatic resistance unit 18 need not include such a mechanism in all applications.

To produce a more constant resistance force over the stroke length of the piston rod 154, the bearing 168 is offset from the center of the main pulley 166. The offset position causes the block-and-tackle mechanism 120 to gain additional leverage relative to the pneumatic actuator 150 as the main pulley 166 rotates. As the piston rod 154 is forced into the cylinder 152, the main pulley 166 rotates, thereby moving the bearing 168 away from the side of the main cable 144 that is connected to the block-and-tackle mechanism 120. The main pulley 166 thus acts as a simple beam with a movable fulcrum. The increased distance between the point where the block-and-tackle mechanism 120 pulls on the main pulley 166 and the point at which the pneumatic actuator 150 acts on the main pulley 166 (i.e., the bearing 168) causes the block-and-tackle mechanism 120 to have increased leverage as the piston rod 154 moves upward. Additionally, the offset position causes the pneumatic actuator 150 to pivot and produce a force vector that is skewed relative to the direction in which the main pulley 166 is being drawn. Accordingly, a decreased proportion of the resistance force created in the pneumatic actuator 150 opposes the movement of the main pulley 166 toward the cylinder 154. The other force component ineffectively forces the main pulley 166 toward a side of the housing 84. Thus, the effective force experienced by a user will remain generally constant throughout the entire stroke of the piston rod 154.

In the illustrated embodiment, the cylinder 152 is generally vertically oriented when the stroke begins but pivots toward the first side of the housing 84 as the stroke progresses. For this purpose, the bearing 168 is initially configured such that a line L that passes through the center of the main pulley 166 and the bearing 168 lies generally normal to the stroke axis of the piston rod 154. In the illustrated embodiment, the line L extends horizontally at the beginning of the stroke. The cylinder 152 preferably does not cause the main pulley 166 to pull away from the cable support member 174.

A similar effect may also be achieved by changing the profile of the guide (e.g., the cable support member 174) or the shape of the main pulley 166 such that the pneumatic actuator 150 pivots as the main pulley 166 moves toward the cylinder 150. The result again is that the block-and-tackle mechanism 120 gains leverage and only a portion of the resistance force produced by the pneumatic actuator 150 opposes the movement. It also is understood that this effect can be achieved with gears and like mechanisms in place of the main pulley and main cable.

Rather than maintain a constant force, these techniques can also be used either alone or in combination to produce resistance force curves that increase and decrease throughout the exercise stroke. For example, when exercising certain muscles or muscle groups, the resistance force desirably increases toward the middle of the stroke and then decreases at the end. The initial orientation of the pneumatic actuator, the degree of offset of the bearing (if any), the initial position of the bearing, the shape of the main pulley, and/or the profile of the guide can be used to produce the desired force curve.

The cable support member 174 is disposed on one side of a vertical plane running through the center point of the main pulley 166 parallel to the pulley's axis of rotation, and the point of attachment (e.g., the pivot pin 156) of the pneumatic actuator 150 to the frame 104 is located on the other side of this vertical plane. Additionally, the bearing 168 is on the same side of the vertical plane as the point of attachment of the pneumatic cylinder 152 to the frame 104, at least when the extension mechanism 78 is in its retracted position. As may also be understood from the illustrated embodiment, the stroke axis of the piston rod 154 extends in a direction generally parallel to the cable support member 174.

In the illustrated embodiment, the stroke of the pneumatic cylinder piston rod 154 is about 12 inches, and the main pulley 166 has a diameter of about 8 inches. Over the full stroke of the piston rod 154, about 12 inches of cable 144 unwinds from the main pulley 166. Thus, with each piston stroke, the lower pulley block 124 moves about 24 inches, or about 2 feet. Since the block-and-tackle mechanism 68 is configured to increase the stroke length by 3 times, a total cable stroke at the coupler 76 is about 6 feet. In this manner, a compact, light and reliable resistance unit 18 provides 6 feet of cable travel.

In a preferred implementation, the main pulley 166 is substantially circular, has a diameter of about 8 inches, and the bearing/connection point of the main pulley is disposed ⅞ of an inch off-center. As discussed above, this configuration of the main pulley 166, combined with the illustrated configuration of the pneumatic resistance assembly 80, provides a generally constant exercise force (e.g., ±10%) throughout the piston rod stroke. It is to be understood that the above dimensions apply only to the illustrated embodiment, are by way of example only and are not intended to limit the invention. The principles discussed above can be employed to create any type of exercise apparatus having any desired stroke length and resistance curves.

It also is to be understood that in other embodiments it may be desirable to have a changing force curve over the exercise stroke. Any number of parameters discussed above can be adjusted to custom-tailor such a changing force curve. For example, the offset of the connection bearing can be varied and/or an ellipsoid, irregular or other non-circular main pulley shape can be employed. Also, in the illustrated embodiment, the main pulley is rotated through a range of angles from about 0° to about 170°. Variable resistance forces can also be achieved by beginning rotation at a different angle such as, for example, 5°, −5°, 90°, etc., relative to the horizontal.

Pneumatic Supply and Control

With reference to FIG. 9, a source of compressed air 180 supplies compressed air to the resistance units 18 to charge the cylinders 152. All of the valves and electronics preferably are located in one of the resistance units (e.g., the left resistance unit in the illustrated embodiment), and only one pneumatic line extends between the two resistance units. However, in other applications, separate valves can be used for each resistance unit.

An inlet valve 182 controls air flow into the pneumatic circuit of the resistance units 18. As noted above, a button 162 on the front cover of the left resistance unit 18 and/or a foot actuator 200 (not shown in FIG. 9) may actuate the inlet valve 182. When the inlet valve 182 opens, the compressed air pressurizes the charged side of the cylinders 152 via the respective accumulators 158 of both resistance units 18. Pressure within the cylinders 152 thus increases in accordance with the amount of time the inlet valve 182 is open until the system reaches a design limit.

An outlet valve 184 controls air flow out of the pneumatic circuit of the resistance units 18. The "−" button 164 and/or the foot actuator 202 (not shown in FIG. 9) may actuate the outlet valve to discharge air to the atmosphere. The pressure within the cylinders 152 thus decreases as the outlet valve 184 remains open. In one preferred embodiment, the air may be discharged through a muffler-type device before release to the atmosphere in order to keep noise levels down within the apparatus.

As seen in FIG. 9, the air pressure within each cylinder 152 is at least substantially the same, since the accumulators 158 are interconnected through the inlet and discharge lines. Accordingly, in the illustrated embodiment, the resistance forces applied by each resistance unit 18 on the end the weight bar 14 are substantially equal. However, in some applications, the pneumatic circuit can be constructed so as to achieve different resistance forces when desired.

In the illustrated embodiment, the left resistance unit 18 also includes a controller 186, including a microprocessor and a pressure transducer 188. The pressure transducer 188 communicates with the pneumatic circuit at a point downstream of the valves 182, 184 in order to sense the air pressure within the cylinders 152 and outputs a signal indicative of the sensed pressure. The microprocessor receives the output signal and generates a control signal to send to a display unit 190.

The display unit 190 preferably displays the information representing the sensed pressure control signal, which is indicative of the resistance force applied to the weight bar 14 by each resistance unit 18. It can also display such information as, for example, but without limitation, number of reps (repetitions) performed, target number of reps, and/or the number of exercise sets.

The display unit 190 preferably is located so as to be visible by a user located at one of the stations of the frame 12. In the illustrated embodiment, as best seen in FIG. 2, the display unit 190 is positioned above and connected to the housing 84 of the left resistance unit 18. The face of the display unit faces toward a user standing generally between the two end upright members 28*c* of the frame 12.

Operation

In one application for the above-described apparatus, a user positions the weight bar 14 on the bar catches 32 at one of the exercise stations of the frame 12 and then loads the resistance unit couplers 76 onto both sides of the bar 14. Prior to this step, however, the user may adjust the length of cable between the body 88 and the collar 86 of the coupler 76. As noted above, the user attaches the shorter cable 90*a* between the body 88 and the collar 86 for lower work on the apparatus (e.g., bench press exercises) and attaches the longer cable 90*b* between the body 88 and the collar 86 for higher work on the apparatus (e.g., military press exercises).

Each coupler 76 is positioned parallel to the location of the weight bar 14 on the frame 12 by sliding a respective trolley 52 along a respective track 54. Movement of the trolley 52, however, does not extend the user cable 118 from the housing 84. Rather, the sections of the cable 118 that extend about the track end pulley 138 and the second lower pulley 140 remain generally stationary. Movement of the trolley 52 therefore does not work against the resistance assembly 80. The trolley 52 can freely move along the track 54 and can follow any movement of the weight bar 14 relative to the track 54 during an exercise stroke.

Each coupler 76 is installed by slipping the collar 86 over the respective sleeve 14*a* of the weight bar 14. The collar 86 slides over the sleeve 14*a* until the collar 86 fits over and abuts the weight bar hub 14*b*. In this position, the body 88 is disposed directly beneath the weight bar 14, as seen in FIG. 6. This action preferably is done with little air pressure in the charged side of the cylinders 152. Once the collars 86 are attached, the user can increase the pressure within each resistance unit 18 to a desired level.

The user may modify the pressure within each resistance unit 18 using the buttons 162, 164, the foot actuators 200, 202 or a combination of both. Prior to getting into position for an exercise, the user may increase the pressure using the "+" button 162, and decrease the pressure using the "−" button 164. A partner may also manipulate the pressure using these buttons, during or after exercise by the user. Alternatively, the user may use the foot actuators 200, 202 to perform the same pressure adjustment. As illustrated in FIG. 10C, one advantage to using the foot actuators is that the user may assume certain exercise positions and simultaneously adjust the resistance. As shown in FIG. 10C, a user may be lying on a bench within the exercise apparatus 10, in a position to perform a bench press, and may manipulate the foot plate 204 of the foot actuator 200 with his or her foot in order to increase the resistance. Furthermore, the user may manipulate either of the foot plates while exercising in order to adjust resistance during an exercise set without leaving the bench. The user can thus quickly and easily reduce or increase the resistance applied to the weight bar.

The user can also place one or more weight plates 16 on the weight bar 14 after the collars 86 have been connected. The first weight plate 16 abuts against the collar 86 just as it normally would abut against the bar hub 14*b*. Additional plates 16 may be slipped over the bar sleeve 14*a* in a conventional manner. The user then can perform the particular exercise in his or her normal course. In other embodiments, the weight plates 16 and collars 86 can be attached to the weight bar 14 in a different configuration, or the apparatus may be used with only pneumatic resistance.

In one embodiment, the display unit 190 displays information to the user, such as, for example, number of repetitions performed, number of sets performed, target number of repetitions, etc. As the user performs an exercise, the display unit 190 increments the repetitions and sets automatically as the user interface moves. In order to modify the information shown on the display unit 190, the user may send electronic signals using, for example, the buttons 162, 164 on the housing 84. Similarly, the user may send electronic signals using the foot actuators 200, 202. For example, in one embodiment, depression of both buttons 162, 164 or both foot plates 204 may cause the counter for the number of repetitions to reset. In another embodiment, a particular sequence of depressions may allow a user to change the target number of repetitions. A user can thereby use the foot actuators 200, 202 to update stored information without leaving the exercise station.

A user works against the resistance assembly 80 as he or she pulls the extension mechanism 78 from the housing 84. The following describes the operations of the resistance assembly 80 in greater detail.

With reference to FIG. 5, when the resistance assembly 80 is in an unloaded position, a generally horizontal line L intersects the bearing 168 and the center C of the main pulley 166. This position of the main pulley 166 is considered to be 0° relative to horizontal. The piston rod 154 is preferably substantially vertically oriented in this unloaded position. As the user pulls on the user cable 118 so that the lower pulley block 124 moves upwardly, the main cable 144 is also drawn upwardly, thus vertically translating the main pulley 166 and also causing the main pulley 166 to rotate. In the illustrated embodiment, the main pulley 166 rotates from about 0° through about 170° during the full stroke of the piston rod 154.

The offset connection of the piston rod 154 to the main pulley 166 causes the pneumatic cylinder 152 to pivot about the pivot point 156 when the main pulley 166 rotates. As such, the cylinder 152 is directed at least partially toward a first side of the housing 84 when the piston rod 154 is displaced upwardly. As discussed above, the pneumatic actuator 150 exerts a substantial force during compression of the charged side of the cylinder 152. The vertical component of the force is translated along the longitudinal length of the main cable 144. However, the horizontal component of the force tends to urge the main pulley 166 toward the first side of the housing and against the support member 174. Accordingly, although the force exerted by the pneumatic actuator 150 increases, not all of the force is directly opposing the upward movement of the main pulley 166. Moreover, the movement of the bearing 168 away from the block-and-tackle mechanism 120 increases the leverage that the block-and-tackle mechanism 120 exerts relative to the pneumatic actuator 150.

When the piston rod 154 and the main pulley 166 are at a point about halfway through the piston rod stroke, the main pulley 166 has rotated through about 90°. In this position, the bearing 168 is located almost directly above the center C of the main pulley 166. The main pulley 166 also has rolled along the cable support member 174 and is closer to the cylinder 152. Because of the position of the bearing 168, the cylinder 152 has pivoted with the rotation of the main pulley 166. Accordingly, the stroke axis of the piston rod 154 is no longer vertically oriented and is skewed relative to the first and second sections of the main cable 144. Additionally, the distance between the bearing 168 and the section of the main cable 144 attached to the lower pulley block 124 has also increased to provide the block-and-tackle mechanism 120 with additional leverage relative to the pneumatic cylinder 152.

Continued extension of the user cable 118 further rotates the pulley 166 and compresses the piston rod 154 into the cylinder 152. At a point near the end of the piston rod stroke, the main pulley 166 has rotated through about 170° such that the bearing 168 is located almost opposite of where it started. The main pulley 166 also has rolled along the cable support member 174 and lies near the lower end of the cylinder 152. Because of the position of the bearing 168, the cylinder 152 has pivoted further with the rotation of the main pulley 166, and the stroke axis of the piston rod 154 is even more skewed relative to the first and second sections of the main cable 144. Additionally, the distance between the bearing 168 and the section of the main cable 144 attached to the lower pulley block 124 has further increased to provide greater leverage to the block-and-tackle mechanism 120 relative to the pneumatic cylinder 152.

Accordingly, the resistance force exerted by the resistance assembly 80 is generally constant throughout an exercise stroke.

Figure 11A:
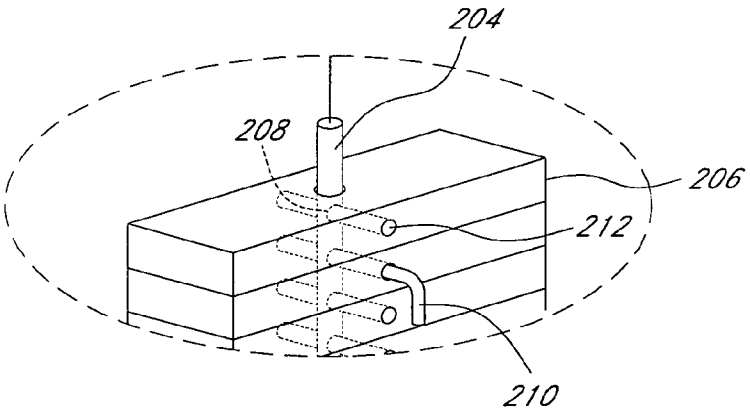
FIG. 11A is a perspective, enlarged view of a portion of the exercise apparatus of FIG. 11.
Figure 11:
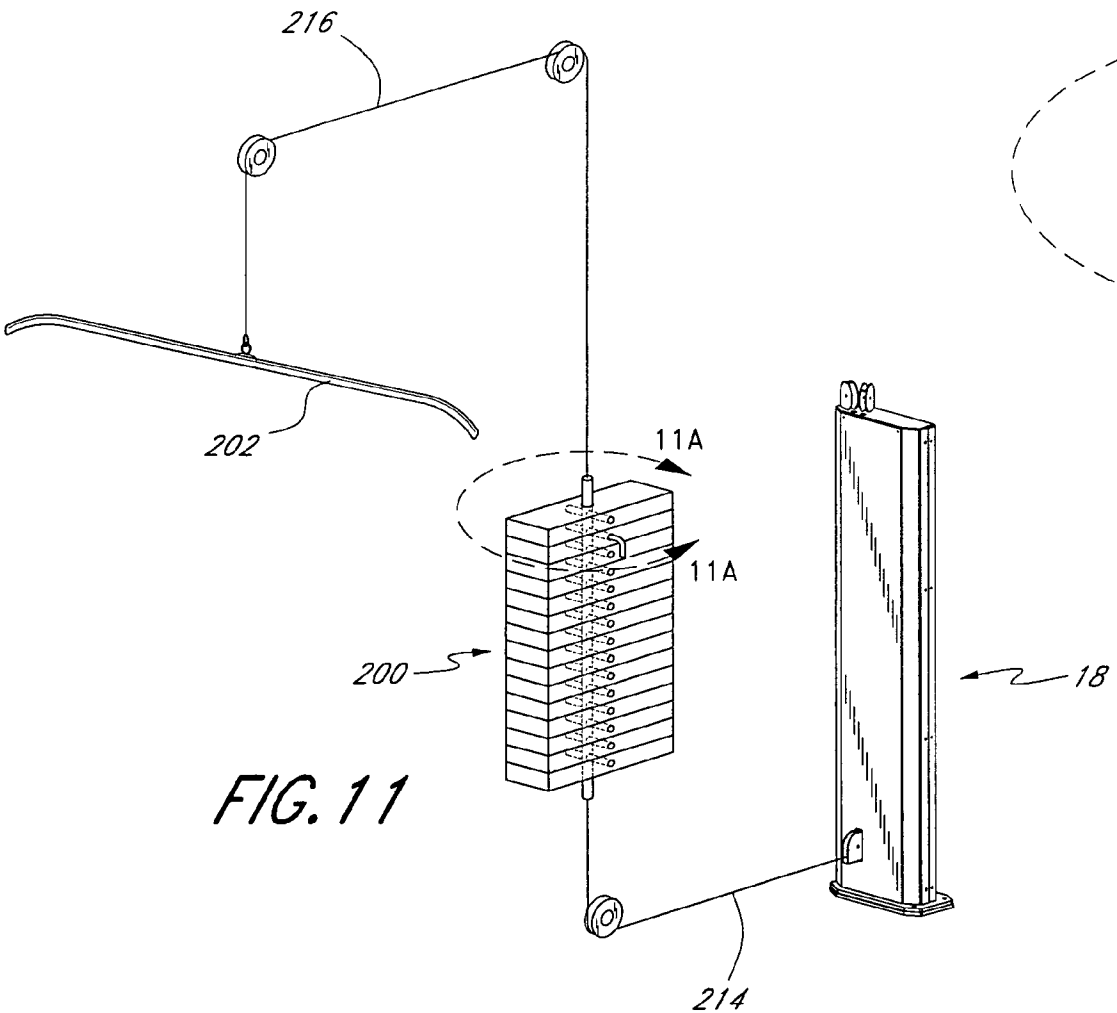
FIG. 11 is a simplified perspective view of an exercise apparatus, which is configured in accordance with another preferred embodiment of the present invention. The illustrated exercise apparatus includes a pneumatic resistance device coupled in series with a weight stack.

In FIG. 11, another embodiment of an exercise apparatus 10 is shown, in which the pneumatic resistance unit 18 is coupled in series to a weight stack 200, which is in turn coupled to a pill-down bar 202. The pneumatic resistance unit 18 is constructed similarly to and generally functions like the unit 18 described at length above. As illustrated, the resistance unit 18, the weight stack 200 and the pull-down bar 202 are connected via a cable-and-pulley system configured similarly to the system discussed above. However, in other embodiments, they may be otherwise coupled, as is well known to those of skill in the art.

Although illustrated as a pull-down bar 202, the user interface may comprise any of a number of bars, padded plates, levers, etc. against which the user can exert a force. For example, in one embodiment, the cable and pulley system can be modified such that the bar 202 functions as a triceps push-down bar, or as a curl bar. Other modifications are well-known to those of skill in the art.

The weight stack 200 preferably comprises a selector shaft 204 running through a plurality of weight plates 206. The shaft 204 has one or more holes 208 extending at least partially through the shaft 204, which can receive a selector pin 210. Similarly, each of the weight plates 206 is preferably configured with a hole 212 extending concentrically with the holes 208 in the shaft 204. Thus, the selector pin 210 can be inserted through a set of holes 208, 212, and the user can thereby select the number of weight plates he or she wishes to lift. Such weight stack operation is well known to those of skill in the art.

In another arrangement, only selected ones of the weight plates 206 in the weight stack may have holes therethrough. In still another arrangement, the selector shaft 204 may have fewer holes than there are holes through the plates 206, such that the shaft 204 may need to be moved prior to the selection of some weight configurations. Other arrangements and configurations of the weight stack 200 may also be used.

As discussed above, the user can also independently choose the amount of pneumatic resistance that will be exerted by the pneumatic resistance unit 18. Therefore, when the user exercises using the pull-down bar 202, the resistance experienced equals the combined pneumatic and weight resistance exerted by the weight stack 200 and pneumatic resistance unit 18 through the cable-and-pulley system.

The cable-and-pulley system preferably comprises at least two cables 214, 216, a first cable 216 extending between the user interface (pull-down bar 202) and the selector shaft 204 of the weight stack 200, and a second cable 214 extending from the pneumatic resistance unit 18 to the selector shaft 204 of the weight stack 200. The first cable 216 may be permanently or releasably coupled at each end, to the selector shaft 204 at one end and to the pull-down bar 202 at the other. Similarly, the second cable 214 may be either permanently or releasably coupled at each end, to the selector shaft 204 at one end and to the pneumatic resistance unit 18 at the other. In the illustrated, preferred embodiment, the first cable 216 is permanently coupled between the user interface and an upper end of the selector shaft 204, and the second cable 214 is permanently coupled between the lower end of the selector shaft 204 and the unit 18. Of course, in alternative embodiments, the cables may be coupled to either end of the selector shaft, such that the connections described above are switched, or the cables may connect to the selector shaft at or near the same end.

Use of the exercise apparatus 10 shown in FIG. 11 may be advantageous for the same reasons discussed above. As one advantage, the user of the apparatus 10 may use a weight stack that functions similarly to conventional weight stacks that the user is accustomed to operating, but pneumatic resistance is added, so that a component of the experienced resistance is generally constant, regardless of the acceleration applied to the user interface.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the pneumatic and weight resistance mechanism has been described in the context of particularly preferred embodiments, the skilled artisan will appreciate, in view of the present disclosure, that certain advantages, features and aspects of the exercise apparatus may be realized in a variety of other applications, many of which have been noted above. For example, while particularly useful for use with free weights, the skilled artisan can readily adopt the principles and advantages described herein to a variety of other applications. Additionally, a single resistance unit can include a coupling mechanism that couples the resistance unit to both sides of the bar or other user interface. It also is contemplated that various aspects and features of the invention described can be practiced separately, combined together, or substituted for one another, and that a variety of combinations and subcombinations of the features and aspects can be made and still fall within the scope of the invention. Thus, it is intended that the scope of the present invention herein disclosed should not be limited by the particular disclosed embodiments described above, but should be determined only by a fair reading of the claims that follow. Additionally, the use of the heading above is for convenience only and should not be interpreted to limit or affect, in any way, the meaning of any of the claim language.

What is claimed is:

1. An exercise apparatus comprising a user interface adapted to be moved during an exercise stroke, the exercise stroke occurring when the user is moving the user interface towards and away from a stationary position of the user's body, a weight stack having a selector shaft coupled to the user interface, and a pneumatic resistance device coupled to the selector shaft and having at least one variable volume chamber and a piston rod which moves through the variable volume chamber during the exercise stroke, the variable volume chamber resisting movement of the piston rod during the exercise stroke, the pneumatic resistance device including at least one valve to regulate the amount of resistance that the pneumatic resistance device applies to oppose movement of the weight stack in at least one direction.

2. The exercise apparatus of claim 1, wherein the selector shaft of the weight stack is coupled to the user interface by a first cable, and wherein the pneumatic resistance device is coupled to the selector shaft by a second cable.

3. The exercise apparatus of claim 1, wherein the pneumatic resistance device includes an accumulator that communicate with the variable volume chamber.

4. The exercise apparatus of claim 1, wherein the pneumatic resistance device comprises a frame and a cylinder, the cylinder being disposed on the frame, a pulley wheel rotatably connected to the piston rod, and a cable wrapped about at least a portion of the pulley wheel and having a first cable end and a second cable end, the second cable end being fixed to the frame and the first cable end being coupled to the weight stack.

5. The exercise apparatus of claim 4, wherein the piston rod is connected to the pulley wheel at a location offset from a center of the pulley wheel.

6. The exercise apparatus of claim 5, wherein the pulley wheel is substantially circular.

7. The exercise apparatus of claim 1 additionally comprising a frame to which the pneumatic resistance device is connected, and at least one pair of supports that are repositionably connected to the frame and are configured to support the user interface.

8. An exercise apparatus comprising a frame, at least one user interface movably coupled to the frame, a pneumatic resistance device having at least one variable volume chamber and a piston rod which moves through the variable volume chamber during an exercise stroke, the exercise stroke occurring when the user is moving the user interface, the variable volume chamber resisting movement of the piston rod during the exercise stroke, and a weight stack coupled to the frame, the weight stack arranged between and in series with the at least one user interface and the pneumatic resistance device and coupled to the at least one user interface by a first force transfer mechanism and to the pneumatic resistance device by a second force transfer mechanism.

9. An exercise apparatus comprising a user interface adapted to be moved by a user towards and away from a stationary position of the user's body, a weight stack having a selector shaft coupled to the user interface, and a pneumatic resistance device coupled to the selector shaft, the pneumatic resistance device including at least one valve to regulate the amount of resistance that the pneumatic resistance device applies to oppose movement of the weight stack in at least one direction, wherein the selector shaft of the weight stack is coupled to the user interface by a first cable, and wherein the pneumatic resistance device is coupled to the selector shaft by a second cable.

10. An exercise apparatus comprising a user interface adapted to be moved by a user towards and away from a stationary position of the user's body, a weight stack having a selector shaft coupled to the user interface, and a pneumatic resistance device coupled to the selector shaft, the pneumatic resistance device including at least one valve to regulate the amount of resistance that the pneumatic resistance device applies to oppose movement of the weight stack in at least one direction, wherein the pneumatic resistance device includes a cylinder having at least on variable volume chamber within a body of the cylinder, and an accumulator that communicates with the variable volume chamber.

11. An exercise apparatus comprising a user interface adapted to be moved by a user towards and away from a stationary position of the user's body, a weight stack having a selector shaft coupled to the user interface, and a pneumatic resistance device coupled to the selector shaft, the pneumatic resistance device including at least one valve to regulate the amount of resistance that the pneumatic resistance device applies to oppose movement of the weight stack in at least one direction, wherein the pneumatic resistance device comprises a frame, a pneumatic actuator having a cylinder and a piston rod that extends from the cylinder along a stroke axis, the pneumatic actuator being disposed on the frame, a pulley wheel rotatably connected to the piston rod, and a cable wrapped about at least a portion of the pulley wheel and having a first cable end and a second cable end, the second cable end being fixed to the frame and the first cable end being coupled to the weight stack.

* * * * *

UNITED STATES PATENT AND TRADEMARK OFFICE

CERTIFICATE OF CORRECTION

PATENT NO. : 7,998,038 B2
APPLICATION NO. : 11/102545
DATED : August 16, 2011
INVENTOR(S) : Dennis L. Keiser It is certified that error appears in the above-identified patent and that said Letters Patent is hereby corrected as shown below:

At Column 8, Line 55, Change "Ivonko™" to --Ivanko™--.

At Column 20, Line 65, Change "pill-down" to --pull-down--.

At Column 22, Line 51-52, In Claim 3, change "communicate" to --communicates--.

At Column 24, Line 8, In Claim 10, change "on" to --one--.

Signed and Sealed this
Tenth Day of July, 2012

David J. Kappos

David J. Kappos
*Director of the United States Patent and Trademark Office*